US005564502A

United States Patent [19]

Crow et al.

[11] Patent Number: 5,564,502

[45] Date of Patent: Oct. 15, 1996

[54] WELL COMPLETION SYSTEM WITH FLAPPER CONTROL VALVE

[75] Inventors: Robert W. Crow, Irving; John C. Gano, Carrollton; Nam V. Le, Lewisville; James R. Longbottom, Whitesboro, all of Tex.; Karluf Hagen, Stavanger, Norway

[73] Assignee: Halliburton Company, Dallas, Tex.

[21] Appl. No.: 381,571

[22] Filed: Jan. 30, 1995

Related U.S. Application Data

[63] Continuation-in-part of Ser. No. 274,175, Jul. 12, 1994, Pat. No. 5,479,989.

[51] Int. Cl.[6] ..... E21B 33/12

[52] U.S. Cl. ..... 166/386; 166/316; 166/387

[58] Field of Search ..... 166/133, 316, 166/318, 334, 373, 386, 387

[56] References Cited

U.S. PATENT DOCUMENTS

| | | | |
|---|---|---|---|
| 2,162,578 | 6/1939 | Hacker | 255/72 |
| 3,865,141 | 2/1975 | Young | 137/629 |
| 3,955,623 | 5/1976 | Aumann | 166/0.6 |
| 4,077,473 | 3/1978 | Watkins | 166/323 |
| 4,160,484 | 7/1979 | Watkins | 166/317 |
| 4,161,960 | 7/1979 | Watkins | 137/458 |
| 4,356,867 | 11/1982 | Carmody | 166/373 |
| 4,372,391 | 2/1983 | Barrington et al. | 166/373 |
| 4,372,392 | 2/1983 | Barrington et al. | 166/373 |
| 4,376,464 | 3/1983 | Crow | 166/324 |
| 4,436,152 | 3/1984 | Fisher, Jr. et al. | 166/214 |
| 4,441,552 | 4/1984 | Hamman | 166/133 |
| 4,449,587 | 5/1984 | Rodenberger et al. | 166/323 |
| 4,457,376 | 7/1984 | Carmody et al. | 166/332 |
| 4,531,587 | 7/1985 | Fineberg | 166/332 |
| 4,583,596 | 4/1986 | Davis | 166/332 |
| 4,605,070 | 8/1986 | Morris | 166/380 |
| 4,674,575 | 6/1987 | Guess | 166/332 |
| 4,834,183 | 5/1989 | Vinzant et al. | 166/332 |
| 4,854,387 | 8/1989 | Pringle | 166/321 |
| 4,890,674 | 1/1990 | Le | 166/319 |
| 5,022,427 | 6/1991 | Churchman et al. | 137/155 |
| 5,086,839 | 2/1992 | Setterberg, Jr. et al. | 166/138 |
| 5,137,089 | 8/1992 | Smith et al. | 166/321 |
| 5,159,981 | 11/1992 | Le | 166/325 |
| 5,285,850 | 2/1994 | Bayh | 166/386 X |
| 5,323,859 | 6/1994 | Smith et al. | 166/321 |
| 5,425,423 | 6/1995 | Dobson et al. | 166/318 X |

OTHER PUBLICATIONS

Otis Engineering Corporation 1974–75 Catalog. Packers and Accessories, p. 3953.

Otis Engineering Corporation 1982 Catalog–pp. 44 and 47. Production Packer Equipment and Services.

Otis Subsurface Safety Systems brochure. Otis Contoured Flapper Subsurface Safety Valve (2 pp.).

*Primary Examiner*—Roger J. Schoeppel

*Attorney, Agent, or Firm*—William M. Imwalle; Shawn Hunter

[57] ABSTRACT

A well control valve assembly prevents flow from or to completion segments further downhole from the well control valve assembly once the stimulation stimulation/shifter string has been removed from the production tubing string. The well control valve assembly features a shaped flapper plate which, when opened, conforms closely to the shape and size of the production tubing string's interior diameter. The flapper plate is biased toward a closed position by a compression spring arrangement that includes an arm which levers the plate upward toward a seating surface. The valve assembly's closure is mechanically induced and is not responsive to a sensed well condition.

12 Claims, 20 Drawing Sheets

WELL COMPLETION SYSTEM WITH FLAPPER CONTROL VALVE

This is a continuation-in-part of U.S. patent application Ser. No. 08/274,175 U.S. Pat. No. 5,479,989.

BACKGROUND OF THE INVENTION

1. Field of the Invention

The present invention relates to systems and methods for production of petrochemicals including those for stimulating the production of petroleum from a well. The invention also relates to systems and methods for enhanced production of petrochemicals from single or multiple subterranean zones, or single or multiple sections of such zones, in various completions, including horizontal completions. The invention also relates generally to a well control valve, specifically, a flapper valve having a specially-shaped flapper being used as a mechanically-operated well control valve that is a vital part of a single-trip well completion system used to improve productivity and enhance control of the well.

2. Description of the Related Art

During a typical production operation of a multizone completion, a production string is introduced into a cased wellbore which has been previously perforated and the string is then placed so that production ported nipples are positioned proximate the perforations. Packers are then set between the production string and the wellbore casing so as to isolate the production ported nipples and perforated sections into production zones. During a well's completion, production must often be stimulated by injection of acid or other chemicals into the perforations. To accomplish this, a stimulation tool is introduced into the production string and positioned so that acid flow ports are aligned with the production ported nipples.

Present systems and methods for completion and stimulation of production zones have certain disadvantages. For instance, because the stimulation tool is introduced separately from the production string, it is difficult for operators to properly locate the acid flow ports in relation to the production ported nipples, which can cause the acid to be misplaced. Separate running of the stimulation tool for each zone to be treated results in extended rig times, which significantly increases cost.

Problems can also occur when a stimulation tool or other tool is being removed from the wellbore. As the stimulation tool is removed from the wellbore, fluids are swabbed out of the well in the process, causing the well to become unstable. In horizontal production arrangements, formation pressure may vary significantly at the same depth or for relatively small changes in true vertical depth. Thus, some zones to be completed may have greater pressure than the hydrostatic head while other zones may be at lower pressures than the hydrostatic head. The effect of these pressure conditions is that some of the zones in the horizontal well will tend to take on fluids while others will tend to flow, resulting in what is termed an underbalanced situation. Present solutions to these problems, including increasing mud weight, can be time consuming and may damage formations, adversely affecting potential recovery of hydrocarbons.

Existing devices used to address swabbing and/or control of underbalanced situations include foot valves and closing sleeves. Foot valves are mechanically operated flowbore valves which are controlled through tubing manipulation by a well operator. The foot valve is most often a valve which closes the wellbore as an operator removes a "stinger" or other tubular member from the valve assembly. The foot valve is reopened by means of a stinger which is inserted into the valve assembly to mechanically open the valve.

Foot valves are distinct in operation and employment from other wellbore valves such as safety (or "fail safe") valves and other surface controlled valves. Safety valves are normally closed valves and are designed to close automatically in response to one or more sensed well conditions, such as those indicative of an emergency. Although "surface controlled" valves may be closed at will, rather than automatically, they require some sort of auxiliary control means to operate. Surface controlled valves are opened and closed either by electrical control or by means of hydraulic pressure actuation. Although valuable, surface controlled valves are vulnerable to interruptions in their control means. Because of the difference in function, foot valves are typically employed much deeper within a wellbore than a safety valve. A safety valve is normally employed in depths above 2,000 feet in order to close off the well in case of an emergency. A foot valve, however, is usually required deeper in the wellbore (5000–20,000 feet) and in the vicinity of the lower most production packer.

One example of a foot valve is the Otis 212FO Back-Pressure Valve (PC/5063) which was marketed by the Otis Engineering Corp. in the late 1960's. The Back-Pressure Valve, attached to the bottom of a packer, was designed to shut off flow from below the packer when the sealing unit and tail pipe were removed. The valve featured a pivotable flapper-type plate which sealed against a resilient seal and metal seat.

Ball-type foot valves are also known. The Otis "PERMA-TRIEVE"® Packer with Foot Valve, for example, employs a ball-type valve which is connected to the bottom of a packer and opened and closed by a stinger run on tubing with an Otis Seal Unit. After the packer is set, the seal unit with stinger attached opens the foot valve as it enters the packer bore. When the seal unit is retrieved, the stinger is designed to close the valve as it is removed.

It may be desirable to perform work in a wellbore at a depth below where the foot valve have been installed. Due to the size (outside diameter) and configuration of the tools to be inserted, and the internal restrictions of the prior art valves, it can be difficult, if not impossible, to perform the desired work below such valves without removing them. The prior art valves described above are difficult to conveniently fit into the wellbore while maintaining the full bore of the production string's inside diameter. Due to their size and shapes, such valves tend to present obstacles to inserted tools, particularly those with radially extending profiles. Surface irregularities of inserted tools, such as extending keys, could prevent passage of the tools through the valve, prematurely activate the valve or damage the valve. Prior art foot valves having flat flappers do not provide sufficient outside diameter (OD) to inside diameter (ID) ratios to allow full bore tool passage in a restricted casing. For example, the flapper plate of the Otis 212FO Back-Pressure Valve (PC/5063) presents a flat upper face when the valve is in a closed position. When the valve is opened, the flat face will restrict available flowbore space, necessitating a reduction in the size of tools which can be run past the valve. These space limitations dictate against use of a flat plate flapper valve in a well control valve application.

Accordingly, there is a need to improve the economics of well completion by reducing rig time. Toward this end, it is highly advantageous to isolate zones and selectively stimulate the zones of a multiple zone well in a single trip.

There is also a need to provide a stimulation system that provides a positive indication of the position of stimulation tools in the well during stimulation.

There is also need to control the flow of fluids into and out of each of the zones of a multiple zone well, a further need to maintain hydrostatic balance during completion, and a further need to prevent swabbing which may occur upon removal of the stimulation tools from the wellbore.

There is still a further need to provide a well control valve that can be used in a single trip completion system that allows for passage of an inner string through said well control valve while maximizing the outer diameter of the inner string.

Additionally, there is a need to provide a well control valve which prevents flow from the production zones once stimulation of all production zones is completed.

The present invention overcomes the deficiencies of the prior art.

SUMMARY OF THE INVENTION

The terms "upper," "upward," "lower," "below," "downhole" and the like, as used herein, shall mean in relation to the bottom, or furthest extent of, the wellbore even though the wellbore or portions of it may be deviated or horizontal.

It is a primary object of the invention to provide an economical, one-trip completion system which allows for positive indication of the position of stimulation tools in the well during stimulation, which controls the flow of fluids into and out of each of the zones of a multiple zone well and maintains hydrostatic balance during completion, and which includes a well control valve which prevents swabbing upon removal of the stimulation tools from the wellbore.

The present invention provides a system for selective production from, and stimulation of, subterranean production zones while improving productivity and enhancing control of the well. Portions of a production string, which includes packers and sliding side doors, and an internal stimulation/shifter string, which includes shifters, a stimulation tool, a velocity check valve, and a running tool, are assembled and run together as completion segments. A running tool, which is attached at the bottom of the handling string and attached to the top of the stimulation/shifter string, latches to the production string and is used to carry the production string to the production zones within the wellbore. The running tool is unlatched from the production string, leaving the production string in the wellbore proximate the production zones. The handling string is then used to manipulate the stimulation/shifter string by way of the running tool. Thus, the present invention provides a one trip completion system which incorporates an inner string which is run simultaneously with the production string including packers whereby the inner string is removed upon stimulation of all production zones and returned to the surface, leaving the production tubing, packers, sliding side doors, and well control valve in the wellbore.

The consecutive completion segments, with each segment including packers that surround sleeve valve assemblies, and which terminate at the upper end in a well control valve, are run into the cased wellbore so that the acid flow ports operated by sleeve valve assemblies are placed proximate the perforations of prospective production zones. The packers are set, the running tool is released from the inner production string, and then the selected production zones are stimulated as the stimulation/shifter string is moved progressively outward and held in tension, placing acid at each consecutive zone. At each selected zone, the sliding side doors, which are also referred to as sleeves or sleeve valve assemblies, are selectively opened to allow the acid to flow from the acid flow ports into the perforations of the formation, thereby stimulating the selected zone. After stimulation of each of the selected zones, the sleeves can be closed to prevent fluid from flowing into or out of the formation; closing the sleeves is an optional step that can be taken. After all of the zones have been stimulated, the stimulation/shifter string is removed from the production string, mechanically closing the well control valve assembly by tubing manipulation to prevent fluid flow out of the completed zones, into the wellbore, and to the surface.

In one aspect of the invention, a tubing-manipulated well control valve assembly prevents flow from completion segments further downhole from the well control valve assembly once the inner, stimulation/shifter string has been removed from the production string. The well control valve assembly features a pivotable, specially-shaped flapper plate which, when opened, conforms closely to the shape and size of the production string's interior diameter. The flapper plate is biased toward a closed position by a compression spring arrangement that includes an arm which levers the plate upward toward a seating surface. The valve's closure is mechanically induced by tubing manipulation and is not responsive to a sensed well condition.

Reopening of the valve assembly is accomplished by insertion into the assembly of a tubular member. The tubular member may be described in relation to a seal assembly which is capable of reopening the well control valve and securing it in the open position. The seal assembly is incorporated into a running arrangement and inserted into the valve assembly to open the valve assembly and seal the connection between the seal assembly and the well control valve assembly.

In one application, the seal assembly is incorporated onto the mating end of an adjacent completion segment. In this embodiment, a method of production becomes possible whereby completion segments are run into the borehole sequentially. As the running operation for each segment is completed, packers are set and the stimulation string is withdrawn, closing the uppermost well control valve and leaving the emplaced completion segment closed against fluid flow out of the well. As adjoining segments are run into the borehole, the seal assembly on its lower end will secure the well control valve at the top of the adjacent emplaced segment into an open position.

In another application, the seal assembly is incorporated into a contingency reentry tool. For instance, reentry through the well control valve may be desirable to allow further stimulation of each of the production zones or selected production zones. Alternatively, reentry may be desired for opening or closing of selected sliding side doors for management of production from the well. The reentry tool is introduced by a running arrangement into the production string of an emplaced completion segment to reopen the segment's well control valve assembly. Thereafter, stimulation tools or sliding side door shifters may then be introduced into the emplaced completion segment to accomplish further stimulation or opening and/or closing of sliding side doors. After the desired service is concluded, upon removal of the contingency reentry tool from the segment, the well control valve assembly is reclosed.

The utility of the well control valve, stacked completion segments, and other features make the system of the present invention desirable for use in horizontal and deviated wellbores where fluid balancing may be a problem. To address the underbalance problem, the operator may desire to close each sleeve upon stimulation of the corresponding production zone in order to prevent fluid flow either from or into the formations. Thereafter, by manipulation of the sliding side doors of the selected production zones, each production zone can be tested separately and the operator can strategically determine how to optimize production from his well by selecting the appropriate production zones to produce.

The invention is also beneficial in situations where there are numerous potential producing sections in a well since each of these sections can be completed in a single run.

The foregoing has outlined the features and technical advantages of the present invention so that those skilled in the art may better understand the detailed description of the invention that follows. Features and advantages of the invention that are described above and hereinafter form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

DETAILED DESCRIPTION OF THE PREFERRED EMBODIMENTS

Figure 1A:
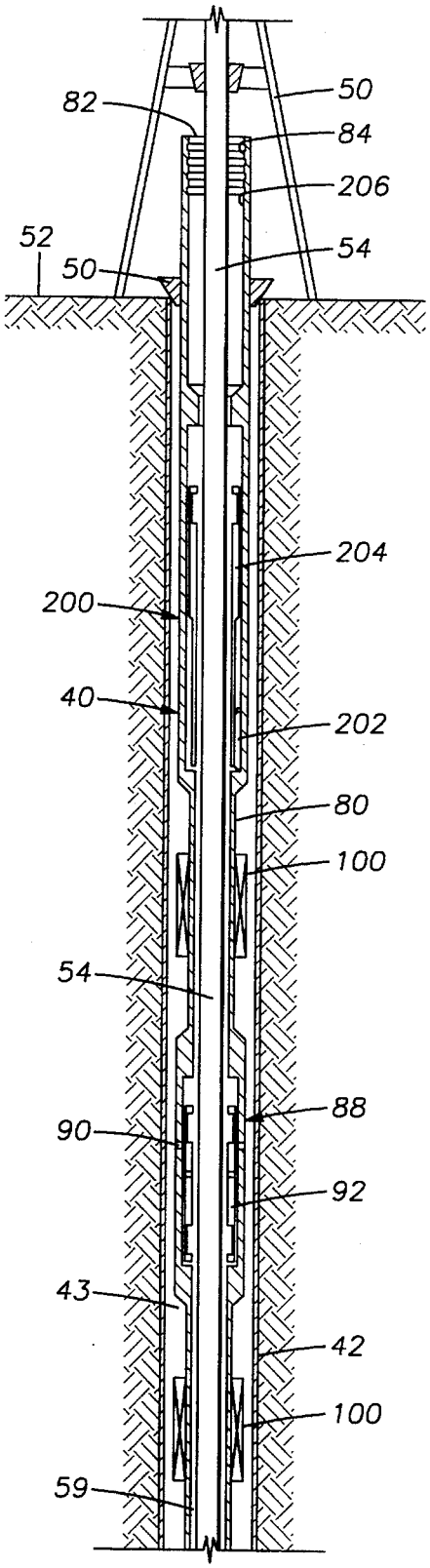
FIGS. 1A–1B show schematically an exemplary completion segment inserted within a wellbore for pressure testing of the stimulation/shifter string.
Figure 1B:
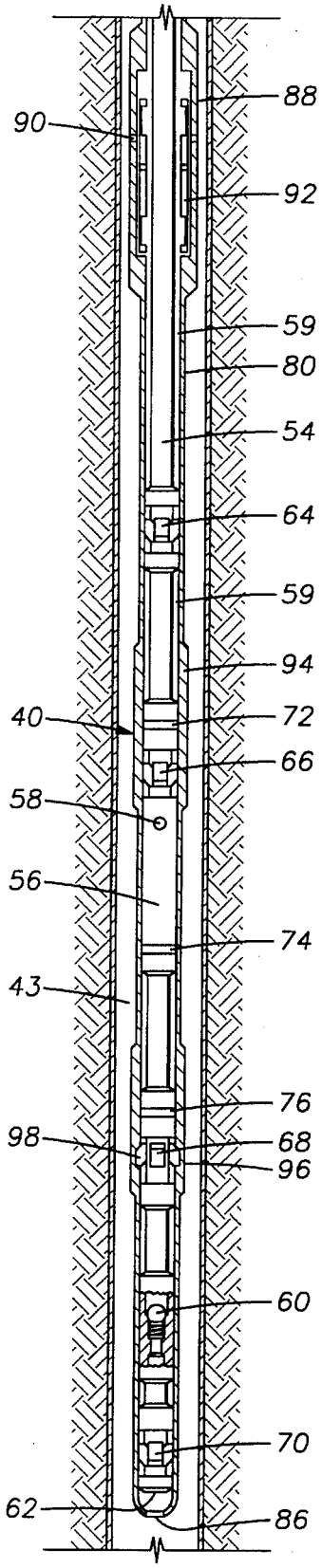

Referring now to the accompanying drawings and initially to FIGS. 1A and 1B, there is shown an exemplary production arrangement. Connections between components, although not specifically described in all instances, are shown schematically and comprise conventional connection techniques such as threading and the use of elastomeric O-ring or other seals for fluid tightness where appropriate.

Referring first to FIGS. 1A–1B through 4A–4B, an exemplary completion segment 40 is shown schematically which has been assembled in the wellbore and is being tested and operated within a cased borehole 42 which defines an annulus 43. As FIGS. 2A–2B through 4A–4B illustrate, the borehole 42 extends through one or more hydrocarbon producing zones 122. The borehole 42 is typically a horizontal wellbore, although it may be any type of well, including a deviated well. The cased borehole 42 has been perforated by perforations 46 to allow the hydrocarbons to flow from the producing zones 122 into the cased borehole 42.

The completion segment 40 is initially suspended, as illustrated in FIGS. 1A–1B, by a support structure 50 at the surface 52. The completion segment 40 is made up of an outer, generally cylindrical production string 80 and an inner stimulation/shifting string 54. A typical completion segment may be between 2500–6000 feet in length.

To make up the entire completion segment 40, the outer production string 80, is made up within the casing. When just one production zone 122 will be completed, the outer production string 80 comprises, from the bottom of the production string 80, a ported nose or aperture 86, polished sub 94 and polished sub with profile 96, a packer 100, a sliding side door or sleeve valve assembly 88, another packer 100, and a well control valve assembly 200 at the very top. For each additional production zone 122 to be produced, an additional sleeve valve assembly 88 and an additional packer 100 is added onto the production string so that packers 100 are located both above and below each sleeve valve assembly 88.

Thereafter, using a running tool, the well control valve assembly 200, with the production string 80 hanging therefrom, is lowered onto the well head and is hung off. Then the inner stimulation/shifter string 54 is made up and comprises, from the bottom, a well control valve shifter 70, a velocity check valve 60, a closing shifter 68, a stimulation tool 56, a locating shifter 66, and an opening shifter 64. A running tool 910 is connected, preferably with a thread connection, to the top of the inner stimulation/shifter string 54. The running tool 910 is then latched into the well control valve assembly 200. Shear pins (not shown) are then inserted into a release mechanism of the running tool 910 to select the pressure at which the running tool will release from the production string 80, thereby allowing the stimulation/shifter string to be manipulated within the production string 80. Sections of tubing are then connected to the top of the running tool; the tubing from the running tool to the surface is referred to as the handling string.

The stimulation/shifter string 54 is an extended tubular structure and includes along its length a stimulation tool 56 having one or more lateral fluid flow ports 58 which permit flow of stimulation fluid laterally outward from the interior of the stimulation tool 56. The stimulation/shifter string 54 is assembled within the production string 80 and axially moveable therewithin. When so constructed, a flowpath 59 is defined between the outer production string 80 and the inner stimulation/shifter string 54.

The stimulation/shifter string 54 includes a velocity check valve 60 near the lower end 62. The velocity check valve 60 permits downward fluid flow out of the lower end 62 until a predetermined closing flow rate, typically 4 barrels per minute (bpm), is reached. After a predetermined differential pressure has been applied, the velocity check valve 60 begins to function as a conventional check valve. In typical current constructions, this differential pressure value is 4000 psi. The stimulation/shifter string 54 carries along its length a number of keyed shifters, including opening shifter 64, locating shifter 66, closing shifter 68, and well control valve shifter 70. The well control valve closing shifter 70 is the lowest component on the shifter tool string 54. The outer surface of the shifter string 54 carries a number of outer annular seals 72, 74, 76. These annular seals may be further termed as an upper acid stimulation seal 72, lower acid stimulation seal 74 and a lower seal 76.

The outer production string 80 presents an upper end 82 which is adapted internally with surface engagement means 84, such as threads or notches, to engage generally complimentary engagement means (which will be described later in this application). An aperture 86 is provided at or near the bottom end of the production string 80 for the passage of well fluids as shifter string 54 is slidably disposed within production string 80. Aperture 86 vents well fluids to prevent a hydraulic lock up of the stimulation/shifter string 54 as the string 54 is moved within the outer production string 80. A number of sleeve valve assemblies 88, also called sliding side doors, are located along the length of the production string 80, each containing a number of lateral ports 90. Each sleeve valve assembly 88 also includes an interior ported sliding sleeve 92 which may be slidingly shifted to permit selective fluid communication between the interior of the production string 80 and the exterior thereof. The sleeves 92 are shifted by means of complimentarily keyed opening and closing shifters 64 and 68 upon the stimulation/shifter string 54. An understanding of the operation of the sleeve valve assemblies 88 and their cooperation with shifters, while not necessary to practice of the present invention, is detailed in the co-pending parent application (U.S. Ser. No. 08/274,175) which is herein incorporated by reference.

The interior of the production string 80 further includes a reduced diameter polished bore 94. The seals 72, 74 and 76 may be selectively located within the reduced diameter polished bore 94 of the production string 80 by movement of the stimulation/shifter string 54 with respect to the production string 80. When one of the seals 72, 74 or 76 is located within the polished bore 94 it will form a fluid tight seal across the polished bore 94.

A locator nipple 96 proximate the lower end of the production string 80 contains an expanded internal locator recess 98 which is adapted to engage the closing shifter 68 as the stimulation/shifter string 54 is moved downwardly within the production string 80. When so engaged, the stimulation/shirr string 54 is secured against further downward movement with respect to the production string 80.

Packers 100 are carried on the outside of the production string 80. The packers 100 are located above and between sleeve valve assemblies 88 so that they may be set to seal off the section of the annulus 43 in which the sleeve valve assembly 88 is located.

A well control valve assembly 200 is located proximate the upper end 82. In a preferred embodiment, the well control valve assembly 200 includes a pivotable, specially-shaped flapper plate 202 and a reciprocally disposed operator tube 204. Operator tube 204, incorporated into the well control valve assembly 200, is considered a tubular member which moves the valve assembly between its open position and closed position by axial movement of the tubular member relative to the flapper plate. In a further embodiment that is not shown by illustration, it is contemplated that the valve assembly can be moved between its open and closed position by movement of a tubular member that is separate from the well control valve assembly. A seal bore 206 is positioned below the threads 84 of the upper end 82. The construction and operation of the well control valve assembly 200 may be better understood and appreciated during discussion of FIGS. 5A–5C through 9A–9E.

The outer production string 80 is initially disposed within the cased borehole 42 near the surface 52 as illustrated in FIGS. 1A–1B by an appropriate support structure 50. The shifter string 54 is disposed within the production string 80 to its fullest extent so that the closing shifter 68 engages the locator recess 98 of the locator nipple 96. With the seals so set, the stimulation/shifter string 54 may be pressure tested against leakage. The seals become set within the production string 80 for testing purposes when the upper acid stimulation seal 72 is located within the reduced diameter bore 94 to prevent movement of fluid upward past the seal 72. Fluid pressure within the stimulation/string 54 is blocked by closing velocity check valve 60 and by seals 72 in seal bore 94 and seals 76 in seal bore 96, thus isolating the ports 58 in the stimulation tool 56.

Figure 2A:
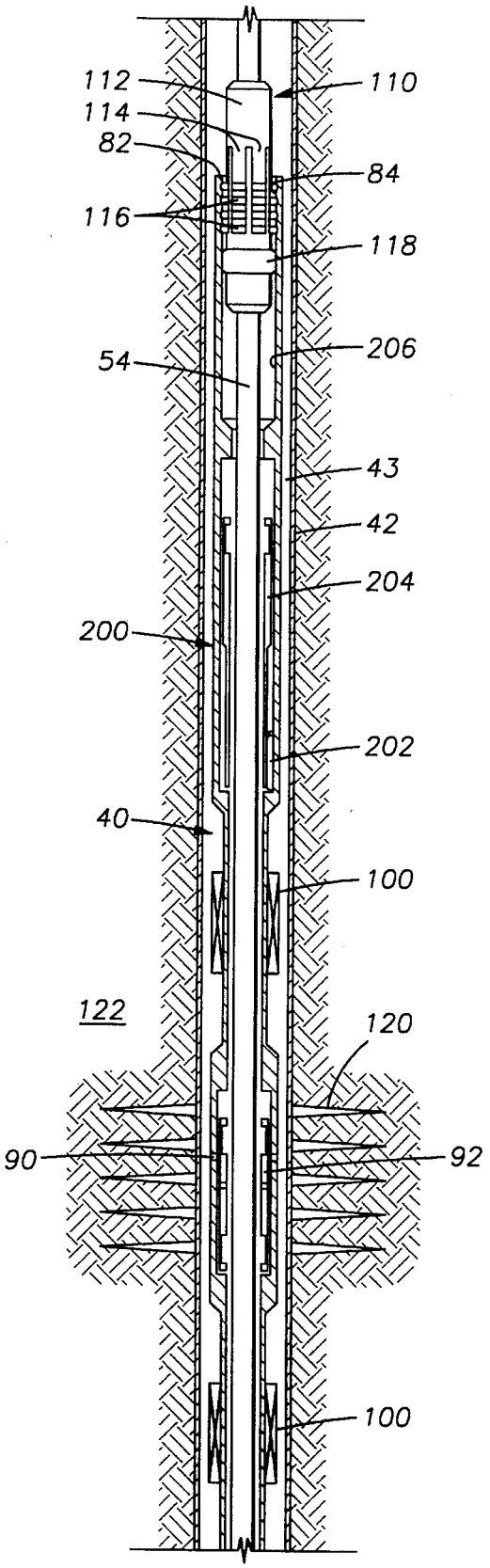
FIGS. 2A–2B show schematically the completion segment of FIGS. 1A–1B being run into a wellbore to depth.
Figure 2B:
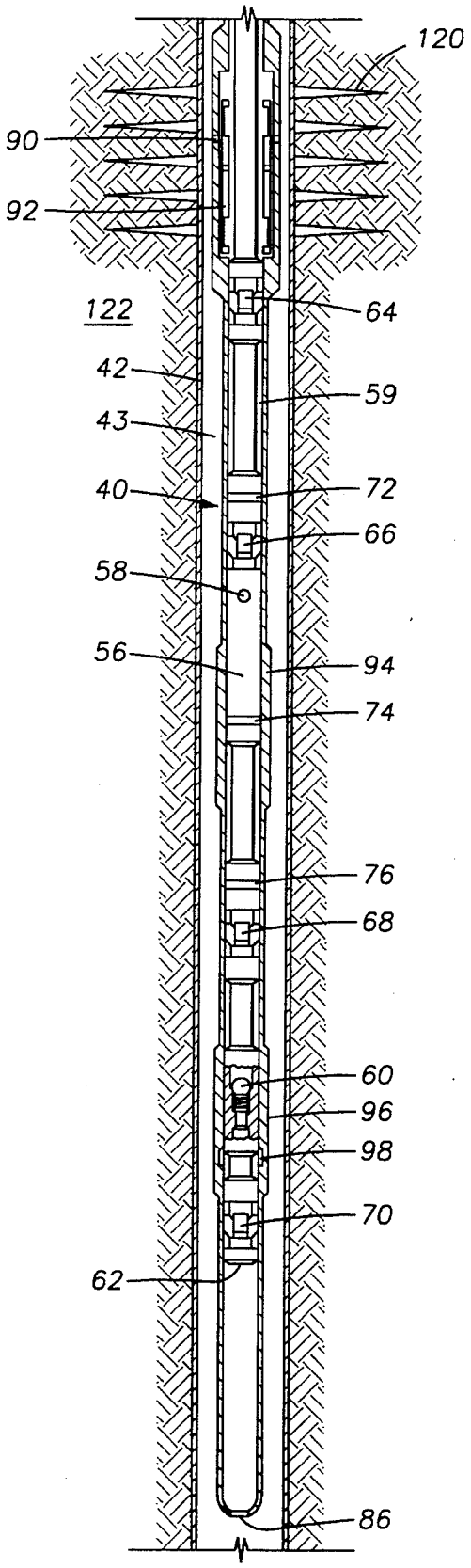

As illustrated in FIGS. 2A–2B, once testing of the stimulation/shifter string 54 has been accomplished, the shifter string 54 is drawn upward and outward from the production string 80. The upper portion of the shifter string 54 is removed and replaced with a running tool 110 which features an end piece 112 is affixed to the stimulation/shifter string 54. The end piece 112 is configured to engage the upper end 82 of the production string 80 allowing the stimulation/shifter string 54 and the production string 80 to be maintained in a locked relation to one another so that the completion segment 40 may be run in a single trip. As may be seen in FIG. 2A, the end piece 112 features downwardly extending collet fingers 114 disposed about the circumference of the end piece 112. The collet fingers 114 each present threaded radial faces 116 which are configured for complimentary engagement with the threads 84 of the upper end 82. The end piece 112 also presents an outward annular elastomeric or other seal 118 which is adapted to fit within the seal bore 206 of the production string 80 and affect a relatively fluid tight seal therewith. The end piece 112 may be engaged with the upper end 82 by forcing the end piece 112 downward within the upper end 82 until the collet fingers 114 deflect radially inwardly and permit the threaded radial faces 116 to mate with the threads 84 of the upper end 82. With the radial faces 116 and upper end threads 84 so engaged, the annular seal 118 creates a seal within the seal bore 206.

Figure 14A:
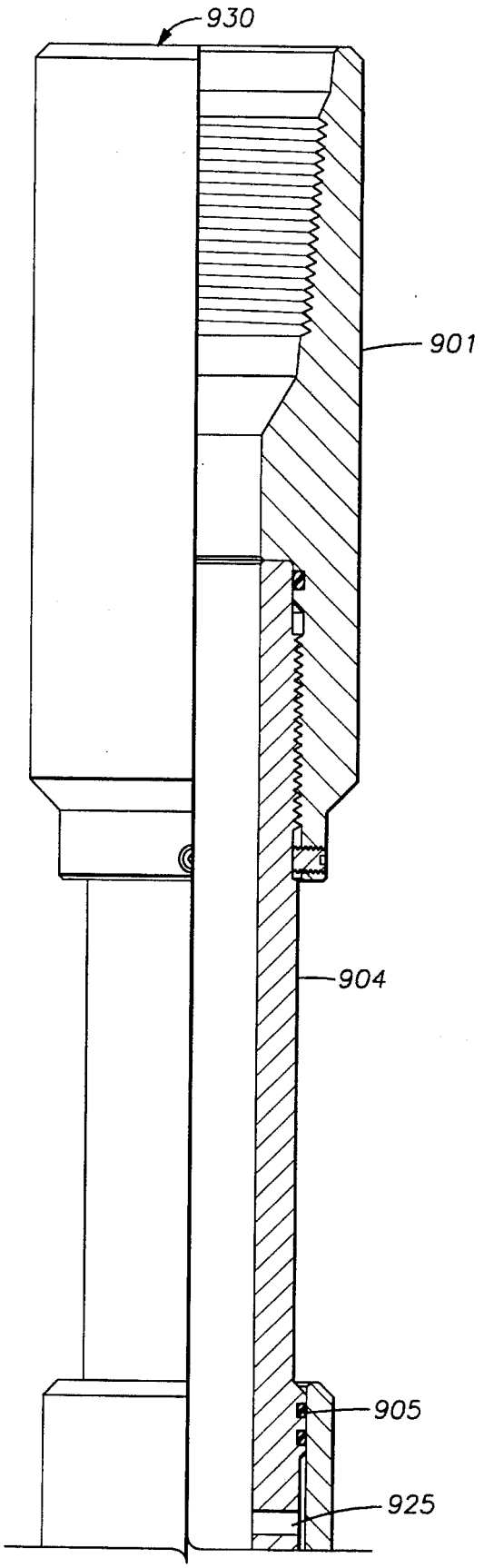
FIGS. 14A–14C present a sectional view of an exemplary running tool having an hydraulic releasable attachment means.
Figure 14B:
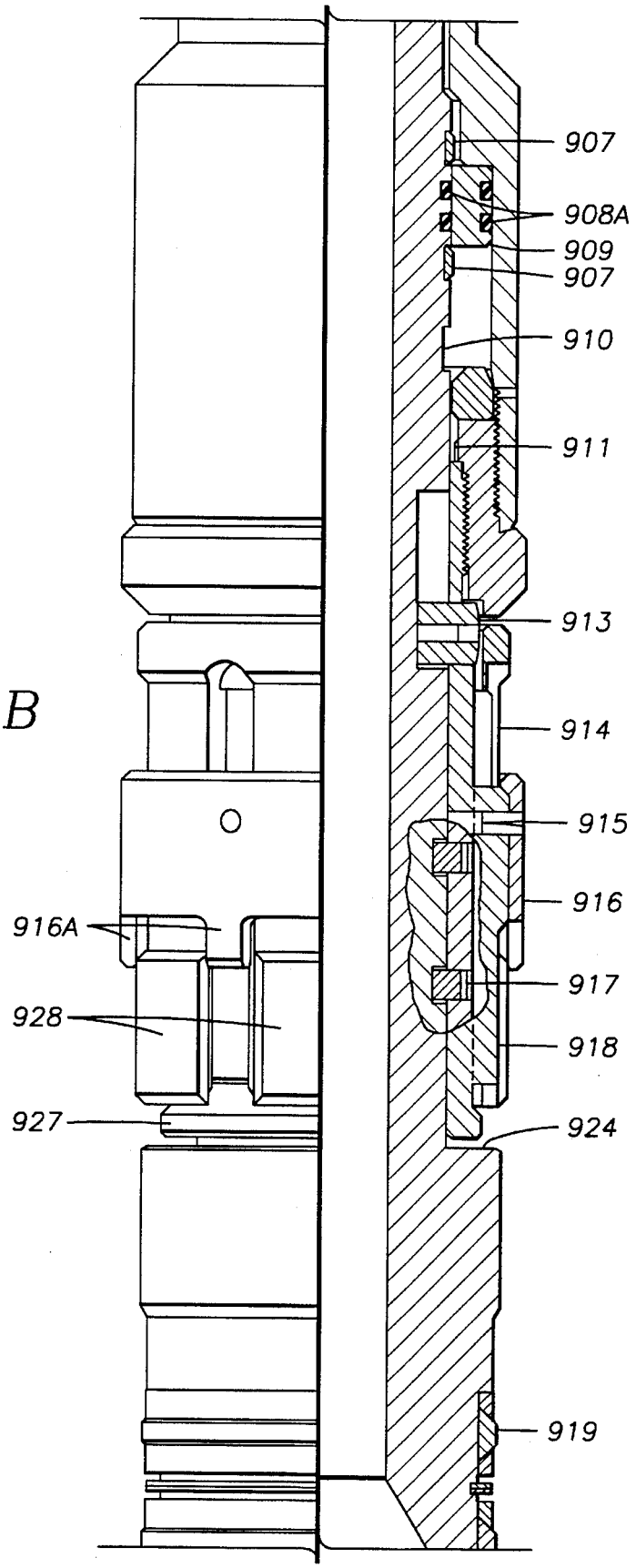
Figure 14C:
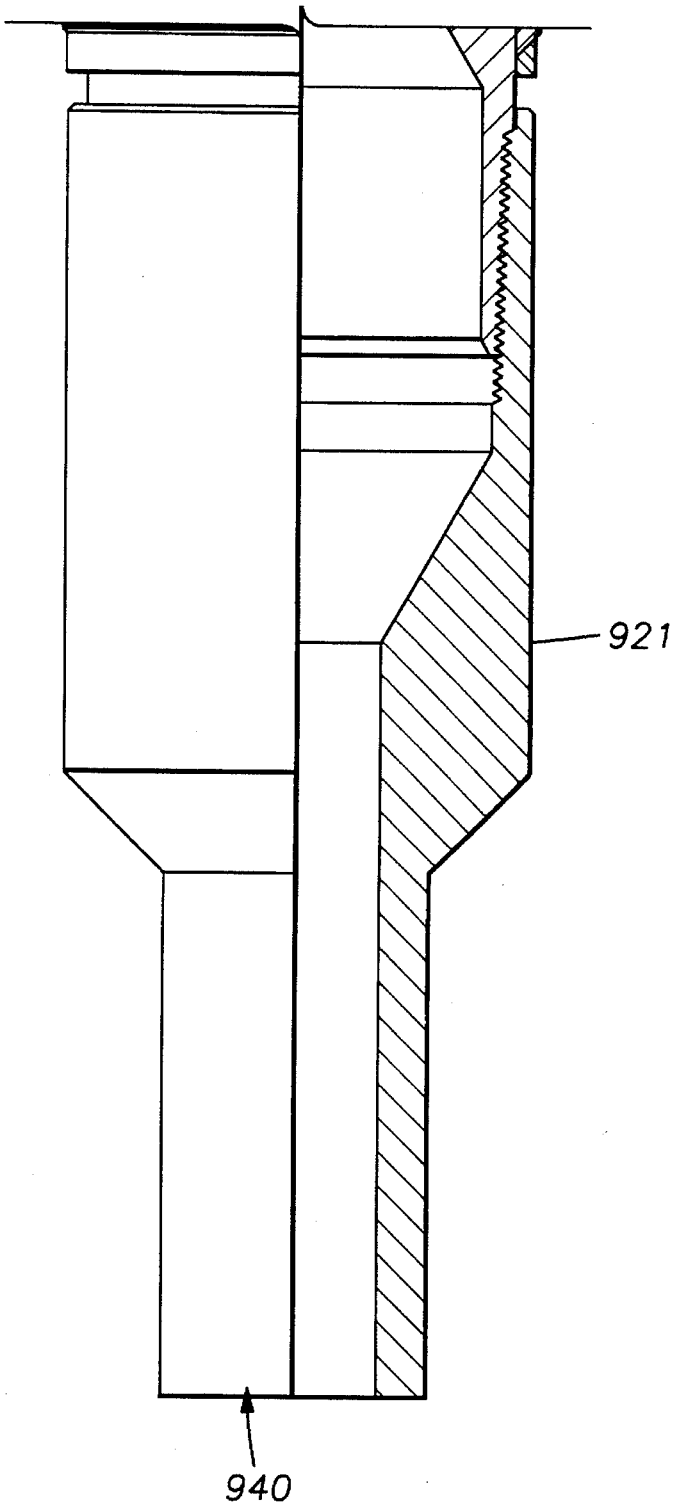

Preferably, the running tool 900 is provided with a hydraulically releasable attachment means. The handling string 45 is threadedly engaged to the top 930 of the running tool 900. As shown in FIGS. 14A–14C, the running tool 900 comprises a threaded adaptor housing 901 with threadedly engages mandrel 904. The mandrel 904 is threadedly engaged to the adaptor sub 921; which, in turn, is threadedly engaged to the inner stimulation/shifter string 54 at the bottom 940.

The mandrel 904 of the running tool 900 carries the hydraulic-piston assembly, which comprises the piston housing 906 and the operating piston 909, which is slidably mounted to the mandrel 904 by retainer ring 907. To hydraulically release the running tool from the well control valve assembly 200, hydraulic pressure is directed down from the surface, through the handling string 45, into the running tool mandrel 904, and out through the port 925, moving the piston housing 906 in an upward fashion. The movement of the housing 906 shears the releasing shear screws 917. The hydraulic pressure is contained within the piston housing 906 by seals 905, 908A and 908B.

After the releasing shear screws 917 are sheared, the collet support surface 927 is moved from supporting the collet fingers 928 of the latch collet 914. Accordingly, the threaded collet fingers 928 can collapse inwardly, releasing the threaded engagement of the collet fingers 928 and the threads of the well control valve assembly 200. Once the piston housing 906 moves upward, latch c-ring 911 locates in latch profile 910, retaining the assembly in the released position. Prior to release from engagement, the running tool 900 is sealably engaged by molded seal 919 within the seal bore 206 of the well control valve assembly 200.

In case difficulty in releasing the running tool is encountered, a secondary release mechanism is provided by means of application of torque to the handling string 45, thereby rotating the adaptor housing 901 and the mandrel 904 in a clockwise manner. The rotation is transmitted from the mandrel 904 via torque lugs 913 to the torque mandrel 918. Meanwhile, torque sleeve 916 is held stationary by the torque lugs 916A, which are engaged with sub 214 of the well control valve assembly 200. Accordingly, the torque shear pins 915 are sheared, allowing the threaded collet fingers 928 to be threadedly disengaged from the threads 84 of the well control valve assembly 200.

When running the completion segment 40 into the wellbore, the weight of the completion segment is carried by the well control valve assembly 200. In turn, the weight carried by the well control valve assembly is transmitted through the threadedly engaged collet fingers 928 to the ratch latch load face 924 of the mandrel 904 and thereafter through the adaptor housing 901 and running string 45.

In general, the attachment means will release the production string 80 from the running tool 910 upon application of a sufficient amount of pressure from the surface and down the stimulation/shifter string 54. The amount of pressure required to release the string 80 from the running tool 910 must be greater than the amounts of pressure required to perform other tasks preliminary to release, such as the setting of packers or closing out of the velocity check valve.

With the running tool 910 engaged as shown in FIGS. 2A–2B, the lower portions of the shifter string 54 are located further upward within the production string 80 than in the testing position of FIGS. 1A–1B. The closing shifter 68 is removed from engagement with the locator recess 98. The upper acid stimulation seal 72 will be located above the reduced diameter bore 94, and the lower acid stimulation seal 74 is located within the reduced diameter bore 94. In this configuration, fluid may flow out of the fluid flow port 58 upward along the flowpath 59 between the production string 80 and the stimulation/shifter string 54. By increasing pressure within the completion segment 40 in this configuration, the integrity of the outer production string 80 may be tested. Leaks in the production string 80 may be repaired.

In another embodiment of the invention, it is contemplated that the completion segment 40 is constructed so that the inner stimulation string 43 is interconnected with the outer production string 80 without a well control valve (not shown); this configuration is used in environments where control of the fluid out of the wellbore is not a concern upon completion of stimulation of the production zones 122. Instead of a well control valve having a flapper plate, a housing is used whereby the housing, which is part of the outer production string, is latched and sealed to the running tool which, in turn, is connected to the internal stimulation/shifter string which is then moved axially within the production string for stimulation.

The completion segment 40 is then disposed further within the wellbore 42 and run to depth until the ports 90 of the associated sleeve valve assemblies 88 are located proximate perforations 120 in desired production zones 122, as depicted in FIGS. 2A–2B.

Figure 3A:
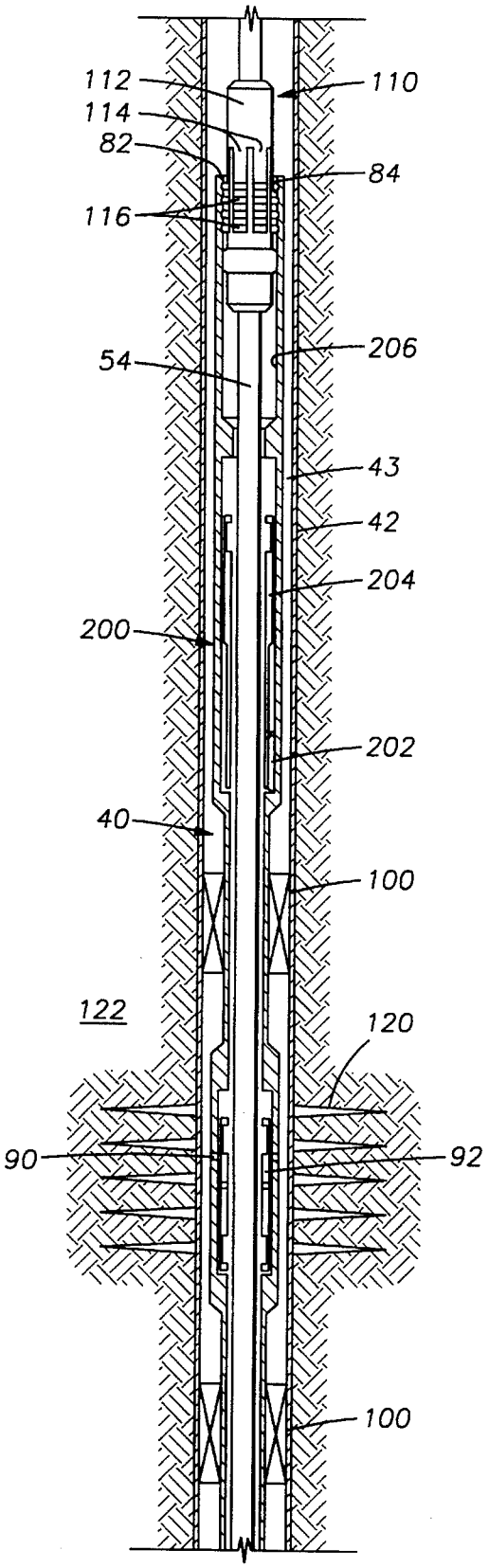
FIGS. 3A–3B show schematically the completion segment of FIGS. 1A–1B having been set within the wellbore.
Figure 3B:
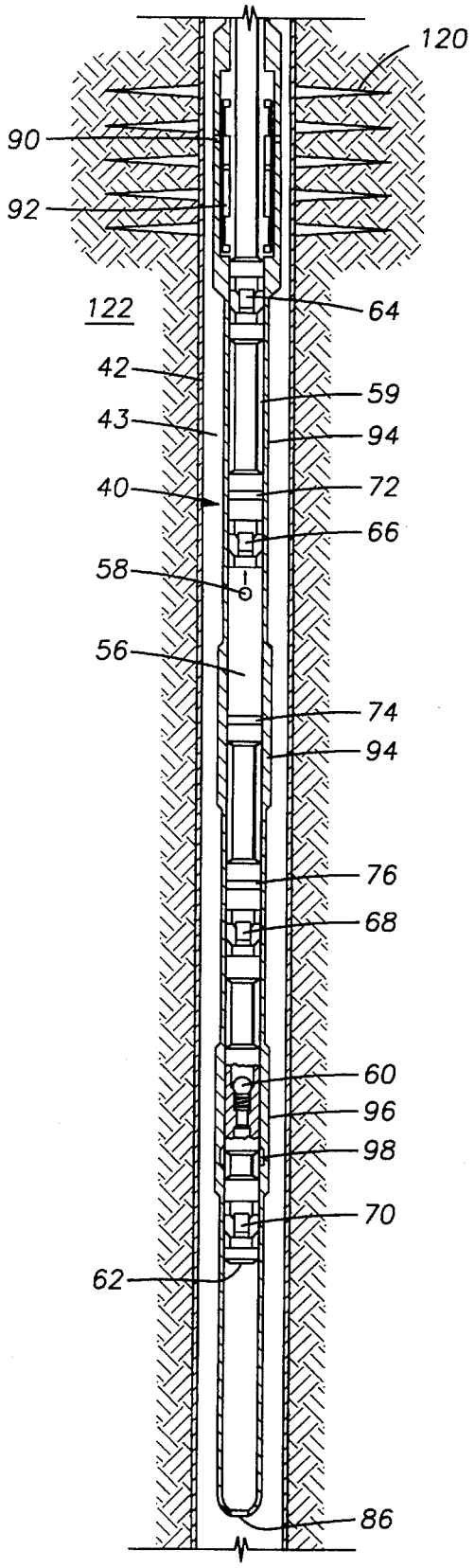

Following pressure testing and disposal of the segment 40 to the proper depth within the wellbore 42, the operators set the packers 100 within the annulus by flowing fluid downward under pressure through the running tool 910 and shifter string 54 and out of the flow :port 58. Pressure exiting the port 58 will move upward along the flowpath 59 until it reaches the level of each packer 100. There it will flow outward through apertures (not shown) in the production string 80 to set the packer 100, as shown in FIGS. 3A–3B.

Figure 4A:
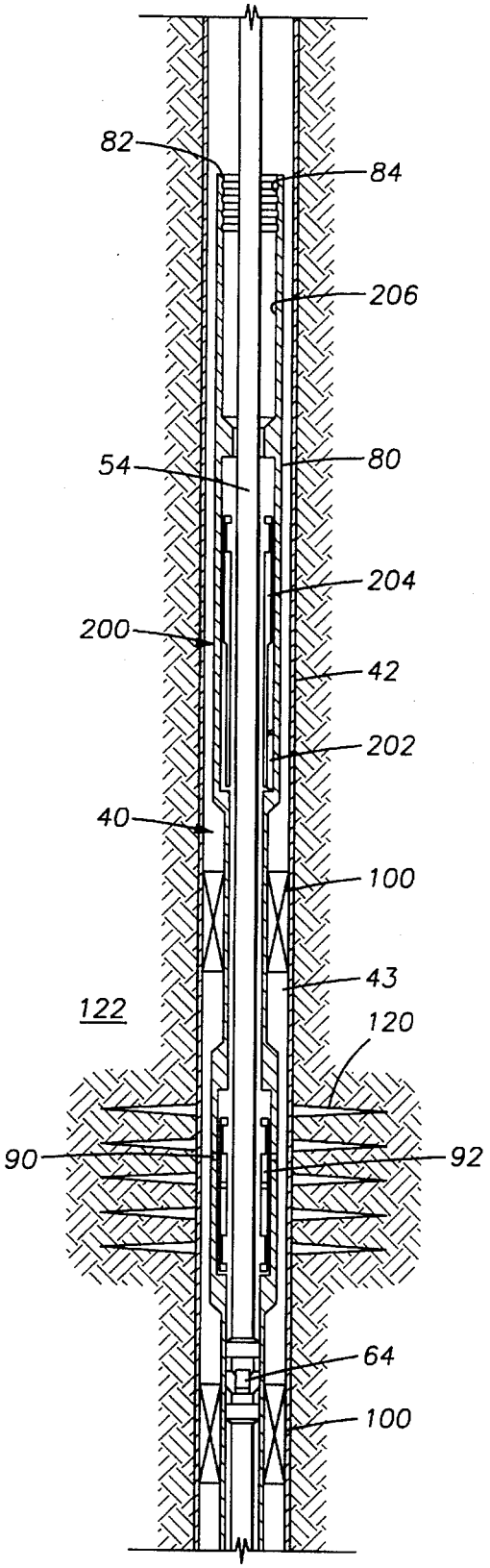
FIGS. 4A–4B show schematically the completion segment of FIGS. 1A–1B being employed for stimulation of a production zone.
Figure 4B:
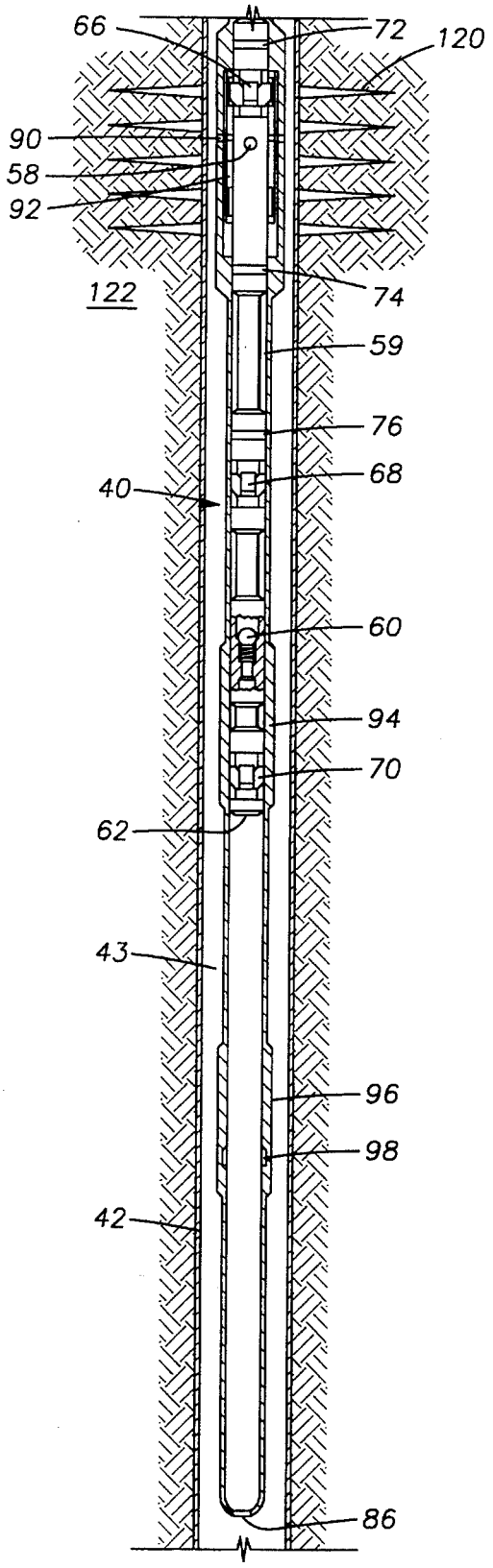

With the packers 100 set, the completion segment 40 has been successfully run, and stimulation of the production zones 122 may take place. The completion segment 40 is operable to selectively inject a stimulation fluid, such as acid, from the surface via the stimulation tool 56 through perforations 120 and into each of the producing zones 122. Turning now to FIGS. 4A–4B, the subsequent stimulation operation is shown. As the running tool 910 and the shifter swing 54 are drawn upwardly, the opening shifter 64 engages and opens the sleeve valve assembly shown in FIG. 4A proximate the production zone 122 which is deepest within the wellbore 42. As noted previously, the details of engagement and opening are described in further detail in the present application's copending parent application (U.S. Ser. No. 08/274,175). Once the sleeve valve 92 has been opened and the stimulation tool 56 located, fluid may be transmitted outward through ports 90 in the production string 80 and into the perforations 120. As the running tool 910 and shifter string 54 are drawn further upward, the opening shifter 64 automatically disengages from the sleeve valve assembly 88 in the manner described in the parent application. The locating shifter 66 will be moved upward and engage the open sleeve valve assembly 88 (see top of FIG. 4B) in a releasably snagged condition as described in the parent application. The snagging condition signals the well operator that the sleeve valve assembly 88 has been opened and that the fluid flow port 58 is properly positioned for stimulation treatment. At this point, acid or another stimulation fluid may be directed down from the surface, through the tubing located above the running tool (known as the handling string), through the running tool 910, and into stimulation/shifter string 54 where it will pass outward through the fluid flow port 58, through the open sleeve valve assembly 88, through ports 90 and into the perforations 120.

The system is designed to provide a positive indication of the position of the stimulation tools during stimulation. Once in the snagging condition, and before pumping of the stimulation fluid from the surface, tension is applied at the surface to the tubing (handling string) at a predetermined load; for example, ten thousand pounds of tension force may be applied. During stimulation, the tubing string may have a tendency to contract or expand as the temperature and pressure of the tubing string change. For instance, upon initiation of stimulation, pumping cold fluid at high rates into the tubing string, which has been in the wellbore environment having a relatively higher temperature, will cause the tubing string to contract. As the tubing contracts, at the surface the operator would see the tension on the tubing increase from the initial, predetermined load. In response to this tubing contraction, which is indicated by an increase in the load on the tubing, the operator should seek to maintain the predetermined load on the tubing by letting off at the surface to decrease the tension. Alternatively, should the tubing expand downhole, the indication at the surface would be that there would be less load on the tubing string. In response to this decrease in the load, the operator should seek to regain the predetermined load by picking up on the tubing string to increase the tension.

Once pumping of the fluid commences, the predetermined load is maintained as described above. If the load on the handling string is lost and the handling string begins to easily come out of the well, this is a positive indication that the stimulation tool has become disengaged and that acid from the sleeve valve assembly 88 is no longer flowing through the sleeve valve assembly 88 and into the appropriate production zone 122. At this point, the operator should cease pumping. To continue stimulation, the operator can then slack off on the stimulation/shifter string 54, lowering the locating shifter 66 back into the sleeve valve assembly 88 for re-engagement.

When a sufficient amount of acid has been flowed into the production zone 122, the locator shifter 66 is disengaged from the open sleeve valve assembly 88. At this point, the sleeve valve assembly 88 can be optionally closed to isolate and prevent flow into or out of the stimulated production zone. The closing of the sleeve valve assembly 88 is achieved by drawing the running tool 910 and stimulation/shifter string 54 upwards until the closing shifter 68, located approximately one joint of tubing below the locating shifter, is positioned above the sleeve valve assembly 88 to be closed. The running tool 910 and stimulation/shifter string 54 are then lowered approximately one-half a joint of tubing and the closing shifter 68 will automatically close and disengage from the sleeve valve assembly 88. Thereafter, the running tool 910 and stimulation/shifter string 54 are drawn upwards to the next production zone 122 to be stimulated.

As set forth in the parent application, each of production zones is then stimulated in sequence, from the lowest zone to the upper most zone, in a like manner. Upon completion of all stimulation and desired manipulation of the sleeve valve assemblies within the completion segment, the stimulation/shifter string 54 is further withdrawn. The well control valve shifter 70 will then engage portions of the well control valve assembly 200, in a manner to be described specifically with regard to FIGS. 6A–6B and 7A–7B, and mechanically close the valve assembly 200 through tubing manipulation of the stimulation/shifter string 54.

Referring now to FIGS. 5A–5D, an exemplary well control valve assembly 200 is shown in greater detail. An outer housing 210 forms a portion of the production string 80 and encloses a flowbore 212 therethrough. The housing 210 is principally made up of a top sub 214, intermediate sub 216, and a bottom sub 218. The top sub 214 is affixed by external threads to the intermediate sub 216. The upper end 82 of the top sub 2 14 includes a beveled rim 222 having a series of notches 214. Below the beveled upper rim 222, an upper bore 226 contains interior threads 84. The lower end of upper bore 226 terminates at a radially expanded notch 228. Intermediate bore 230 extends from the notch 228 to a frustoconical inward and upward facing engagement shoulder 232 below. Seal bore 206 extends from the engagement shoulder 232 down to an enlarged notch 234 which presents an upwardly and inwardly facing shoulder 236. A reduced diameter bore 238 extends to the lower end of the top sub 214.

A tube housing 240 is retained within the intermediate sub 216 between the lower end 242 of the top sub 214 and an upwardly presented stop face 244 at the lower portion of the intermediate sub 216. The radial interior of the tube housing 240 forms a tube cavity 246 defined between a downwardly facing shoulder 248 above and the upwardly facing shoulder 244 below. The tube cavity 246 is made up of an upper, reduced diameter portion 250 and a lower, expanded diameter portion 252, the two portions being divided by a downwardly facing stop face 254. A radially expanded notch 256 is located within the upper portion 250. Below the tube cavity 246, a reduced bore 258 extends from the upwardly facing shoulder 244 to an enlarged threaded bore 260 which, in turn extends to the lower end 262 of the intermediate sub 216.

External threads 264 connect the intermediate sub 216 to the bottom sub 218. The bottom sub 218 encloses a valve housing recess 266, stub bore 268 and a lower bore 270. A tubular valve seat 272 engages the intermediate sub 216 at the enlarged threaded bore 260. A valve housing 265 is disposed within the valve housing recess 266, and a lower extension 267 of the housing is located within the stub bore 268. Pins 269 are disposed through the valve housing 265 to affix the valve seat 272 against rotation. A valve seat collar 271 surrounds the valve seat 272 and is threadedly engaged at 273 to the valve housing 265. The valve seat 272 presents a downwardly and inwardly facing annular seating surface 274 at its lower end.

Figure 6A:
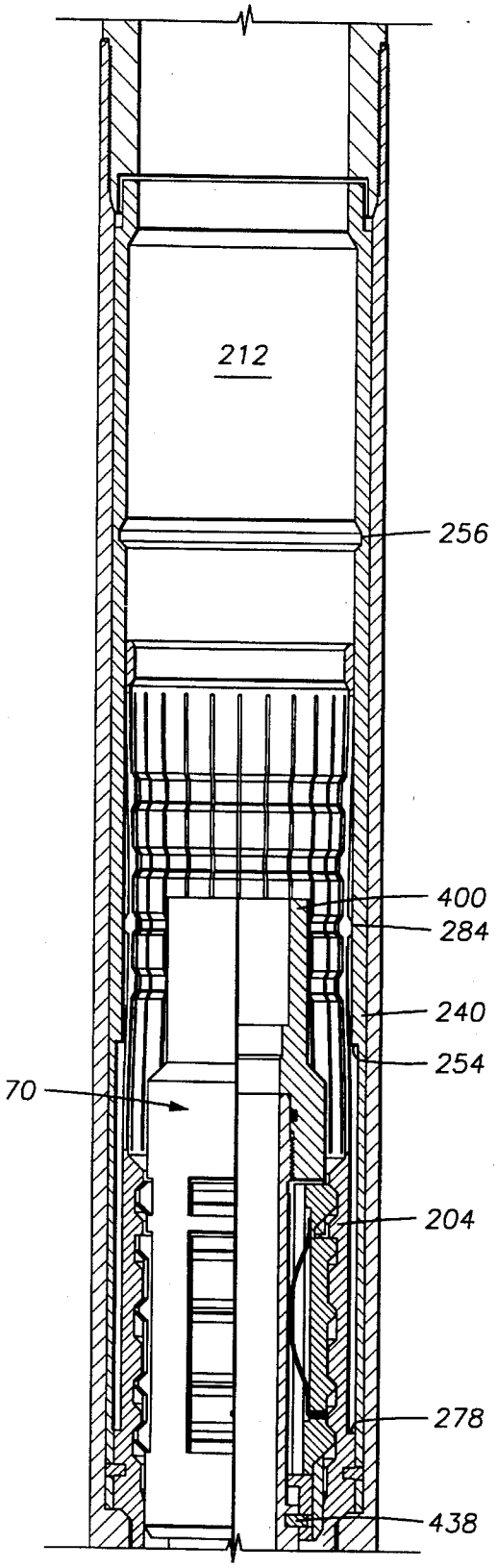
FIGS. 6A–6B present a sectional view of an exemplary well control valve constructed in accordance with the present invention prior to being moved to its closed position.
Figure 7A:
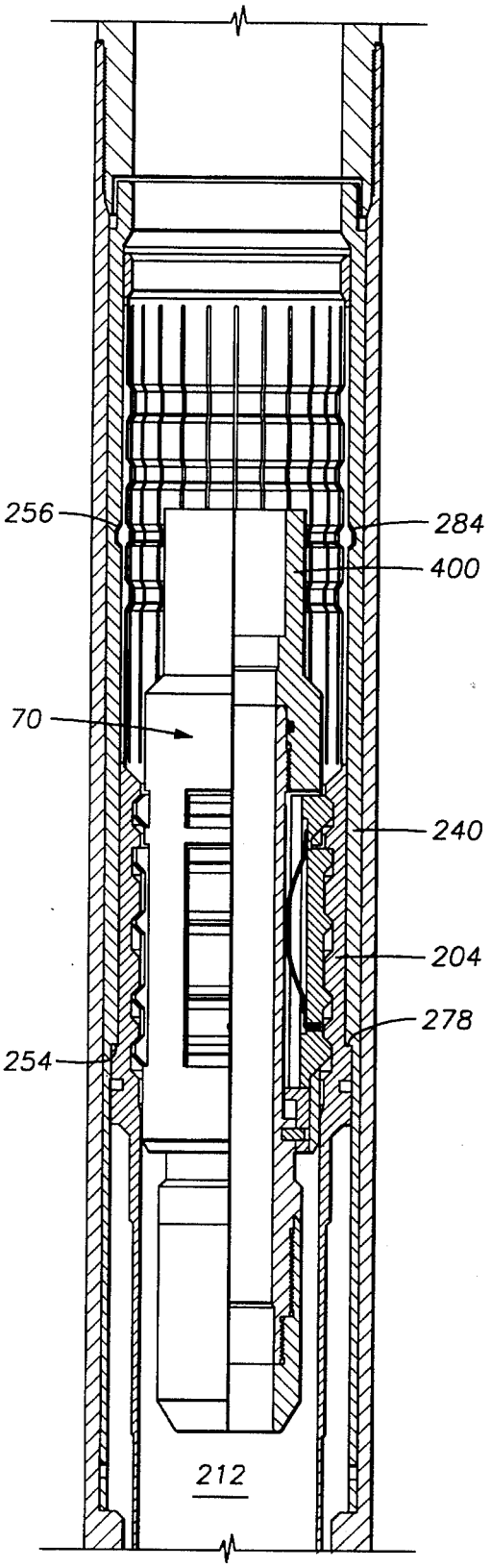
FIGS. 7A–7B present a sectional view of an exemplary well control valve constructed in accordance with the present invention after being moved to its closed position.
Figure 6B:
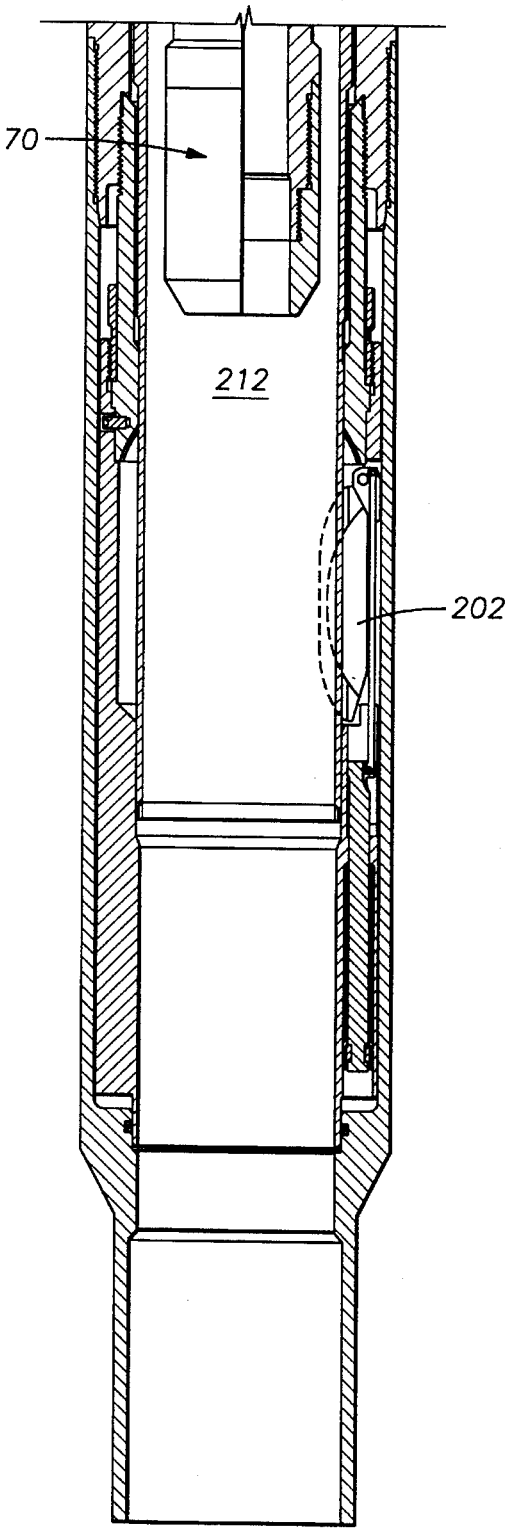
Figure 7B:
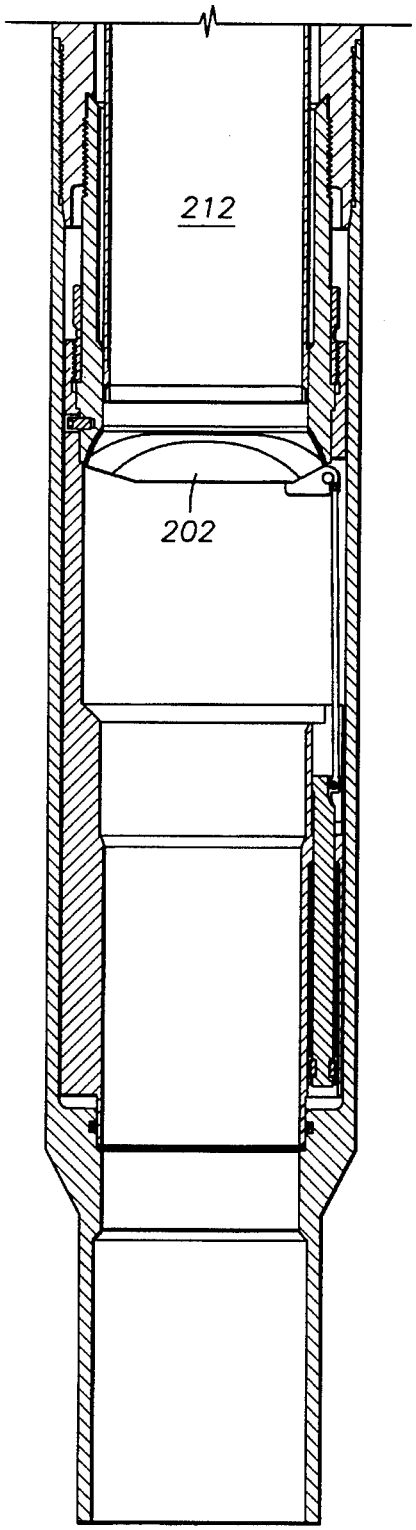

The operator tube 204 is reciprocally disposed within the tube cavity 246 and is moveable between a lower position (shown in FIGS. 5A–5D and 6A–6B) and an upper position (shown in FIGS. 7A–7B). The exterior of the operator tube 204 presents a downwardly facing stop shoulder 276 within the lower portion 252 of the tube cavity 246 which is shaped to be complimentary to the upward facing stop shoulder 244 of the intermediate sub 216. The operator tube 204 also presents an upwardly facing stop face 278 in the lower portion 252 of the cavity 246. The stop face 278 is fashioned to be complimentary to the downwardly facing stop face 254 of the tube housing 240.

The interior surface of the operator tube 204 is profiled to match and engage the profile of a complimentarily-keyed shifting tool within the stimulation/shifting string 54. It is highly preferred that the profile be designed to prevent matching and engagement with all other keyed tools which might be located within the shifting string 54, such as an opening, closing or locating shifters 64, 66, and 68.

Beginning from the upper end of the operator tube 204, an upper ridge 280 projects radially inward and, in cross-section, presents a chamfered upward and inward-facing surface **280*a*, a flat top surface 280*b* and a chamfered downward and inward-facing surface 280*c***.

Surfaces **280*a* and 280*c* are chamfered at approximately a 30° angle from the flat surface 280*b***.

Below the upper ridge, the operator tube 204 includes a colleted section 282 disposed along a portion of its upper length. The outer radial surface of each collet includes a relief engaging bump 284 which is shaped and sized to fit within the radial notch 256 of the tube housing 240 when the operator tube 204 is in its upper position. A non-colleted profiled section 286 is located below the colleted section 282. A prong section 288, or tubular prong, of the operator tube 204 lies below the non-colleted profiled section 286.

The non-colleted profiled section 286 is configured to selectively engage complimentary shifter key profiles. The inner surfaces of the colleted section 282 is configured to engage a complimentary shoulder 56 on tubular member 542. Specifically, this section present a series of radially inwardly projecting annular ridges and intermediate annular recesses such that the profiles of this section will engage the well control valve shifter 70 for closing of the well control valve assembly 200. Many profile configurations are possible which will achieve this objective. Only an exemplary profile configuration is described here. The particular profile described is known as a Select 20-type profile, corresponding to a selective complimentary key tool profile system used with tools marketed by Halliburton Co. It is noted that details of a suitable keyed shifting tool and sliding sleeve arrangement may be found in U.S. Pat. No. 4,436,152 "Shifting Tool" issued to Fisher, Jr. et al. which is incorporated herein by reference.

Colleted section 282 will further engage a seal assembly for reopening of the well control valve assembly 200. Immediately below the upper ridge 280 is a radially expanded recess 290 which extends downward along the length of the colleted section 282.

An engagement bump 292 presents an upper face **292*a* extending upwardly and outwardly at approximately a 45 degree angle, a radially inward presented face 292*b* and a lower face 292*c* which extends downwardly and outwardly at an approximate 45 degree angle. Three inwardly extending "guard" bumps 294, 296 and 298 are located within the colleted section 282. The guard bumps feature upper faces 294*a*, 296*a* and 298*a* and lower faces 294*b*, 296*b* and 298*b*, each of which protrude radially inwardly at approximate 30 degree angles. Due to their inward protrusion, the guard bumps 294, 296 and 298 serve the function of preventing the keys of non-complimentary tools such as the opening shifter 64, locating shifter 66 and closing shifter 68 from engaging the operator tube 204**.

The upper end of the non-colleted profiled section 286 includes an abutment shoulder 300 which presents an upper frustoconical abutment face **300*a* that faces upward and inward at a 45 degree angle and a downwardly facing profile 300*b* which faces inward and downward at about a 30 degree angle. An engagement shoulder 302 is located below the abutment shoulder 300 and presents a 45 degree upper frustoconical face 302*a* and a lower, downward-facing engagement face 302*b* which protrudes inwardly at a 90 degree angle. A series of additional ridges 304, 306, 308 and 310 with adjoining recesses 312, 314, 316 and 318 are included in the profiled section 286, their shapes and configurations chosen for causing selective engagement of the operator tube 204 a complimentary keyed shifter tool and preventing engagement of the operator tube 204** by non-complimentary shifter tools.

Figure 13A:
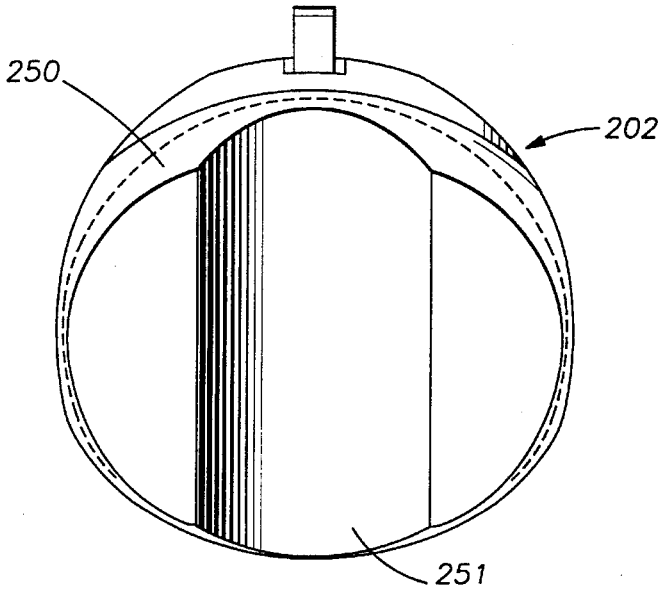
FIGS. 13A–13B depict a specially-shaped flapper plate having a contoured configuration.
Figure 13B:
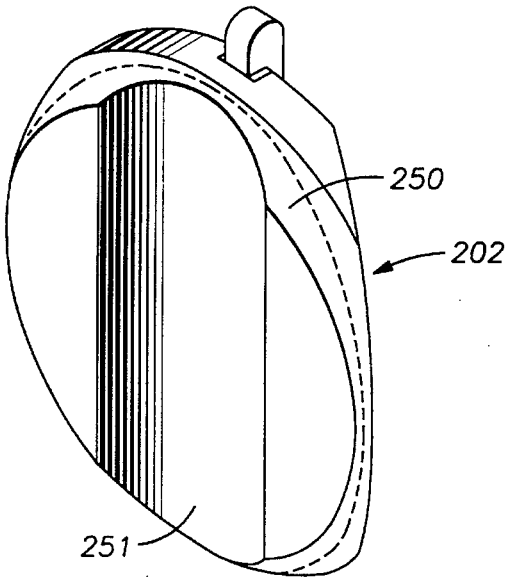

A specially-shaped flapper plate 202 is located in the bottom sub 218 just below the valve seat 272. As may be appreciated by reference to and comparison of FIGS. 6B and 7B, the plate 202 is pivotable between an open position where it is generally aligned with the flowbore 212 and biased towards a closed position where it substantially seals the flowbore 212. It is a feature of the invention that the valve assembly 200 includes a specially-shaped flapper plate 202, which is defined as a flapper plate that conforms closely to the interior profile of a wellbore when opened. The plate is considered to be so specially-shaped when it includes a semi-cylindrical channel which is presented radially inward when the valve is opened. One such plate is the contoured flapper plate described in U.S. Pat. No. 5,137,089 "Streamlined Flapper Valve" issued to Smith et al. and assigned to Otis Engineering Corp., a predecessor corporation owned by the assignee of the present invention. The Smith et al. patent is hereby incorporated by reference. An exemplary flapper plate of this type is depicted in FIGS. 13A–13B. The flapper plate 202 presents a convex spherical segment seating surface 250 to ensure such a seal as described in the Smith et al. patent. The plate 202 also features a semi-cylindrical channel 251 which substantially aligns with the flowbore 212 when the plate 202 is in an open position thereby allowing the plate to conform itself closely to the shape of the inner profile of the flowbore 212 and to facilitate passage of an operating tube, or other tubular member by it.

An alternative and suitable specially-shaped flapper plate of curved configuration is known and described in U.S. Pat. No. 2,162,578, "Core Barrel Operated Float Valve" issued to Hacker also incorporated herein by reference. The Hacker plate is likewise shaped to include a semi-cylindrical channel to facilitate passage of a tubular member. Other types of shaped flapper valves are known in the art as well. The particular configuration of the shaped flapper plate 202 is immaterial. In accordance with the invention, however, the flapper plate must seal when closed to substantially prevent flow through the flowbore 212 in which it is incorporated. It must also include a semi-cylindrical channel which substantially aligns with the flowbore 212 when the plate 202 is in the open position to allow the plate to conform closely to the inner profile of the flowbore in which it is placed.

As also shown in FIGS. 5A–5D, proximate one radial edge of the flapper plate 202 is a tension rod closing arrangement 322 which is described in greater detail in U.S. Pat. No. 5,159,981, issued to Le and incorporated by reference herein. The closing arrangement 322 features a flapper plate pivot 324 and, further radially outward from the axial center of the flowbore 2 12, a rod pivot 326. A moment arm is defined between the flapper plate pivot 324 and the rod pivot 326. Extending downward from the rod pivot 326 is a compression spring biased tension rod 328. As the tension rod 328 is moved axially downward, a clockwise movement is imparted upon the moment arm, thereby closing the plate 202. A resilient compression spring 330 biases the tension rod 328 downward such that the flapper plate 202 will tend to close of its own accord if not restrained into an open position. The biasing provided by the spring 330 should be great enough that the plate 202 will close in this manner regardless of the orientation of the well control valve assembly 200 or the borehole 42. When closed, the sealing surface 250 forms a relatively fluid tight seal against upward fluid flow with the annular seating surface 274 of the valve seat 272.

In an alternative embodiment, it is contemplated that the flapper plate 202 may also be biased towards a closed position using a number of biasing means including a compression spring, a tension spring, a leaf spring, a belville washer, a combination torsion-bending spring, a gas spring or a counter balance.

When in the open position, the flapper plate 202 partially resides within an annular plate recess 332 which is defined below the valve seat 272 and within the valve housing 265. As described further in the Smith et al, '089 patent, the plate 202 presents no obstacle to a tubular member which might be passed through the valve housing 265.

Figure 5A:
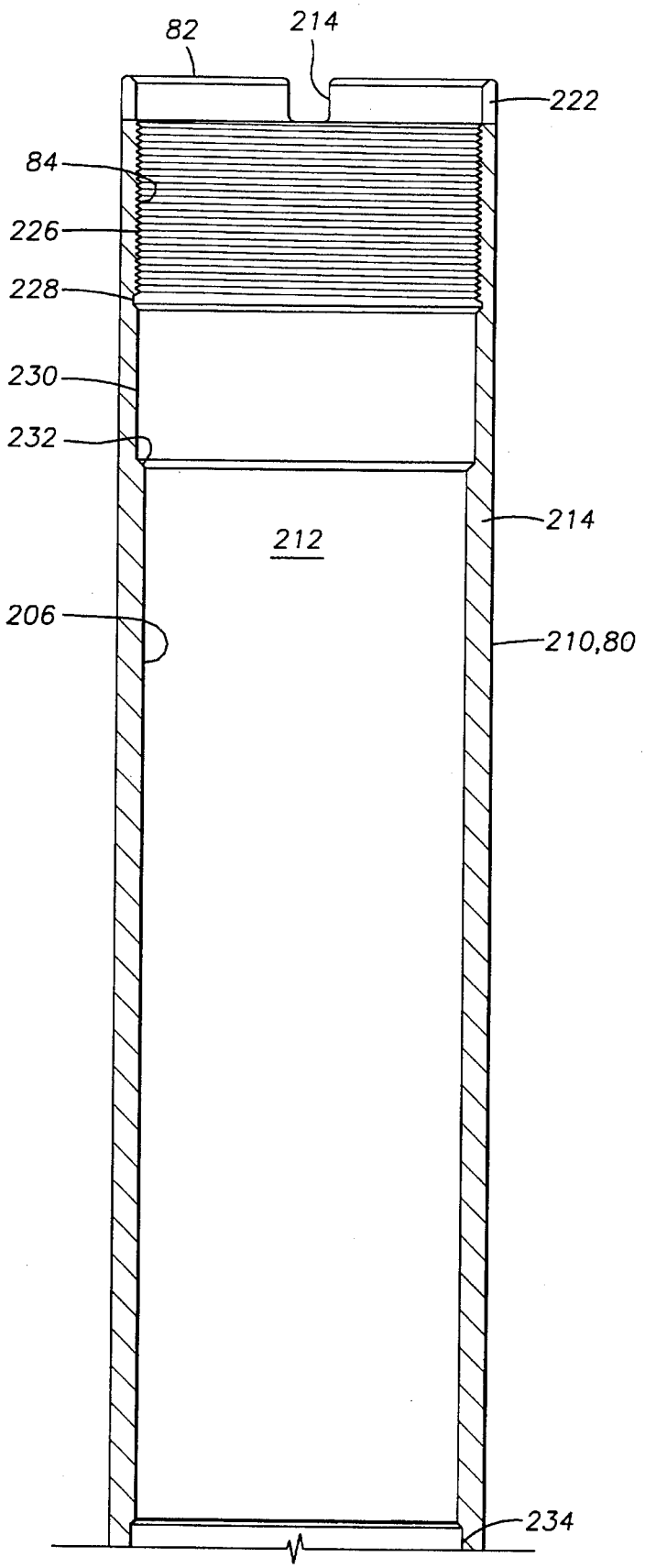
FIGS. 5A–5D present a sectional view of an exemplary well control valve constructed in accordance with the present invention and being maintained in its open position.
Figure 5B:
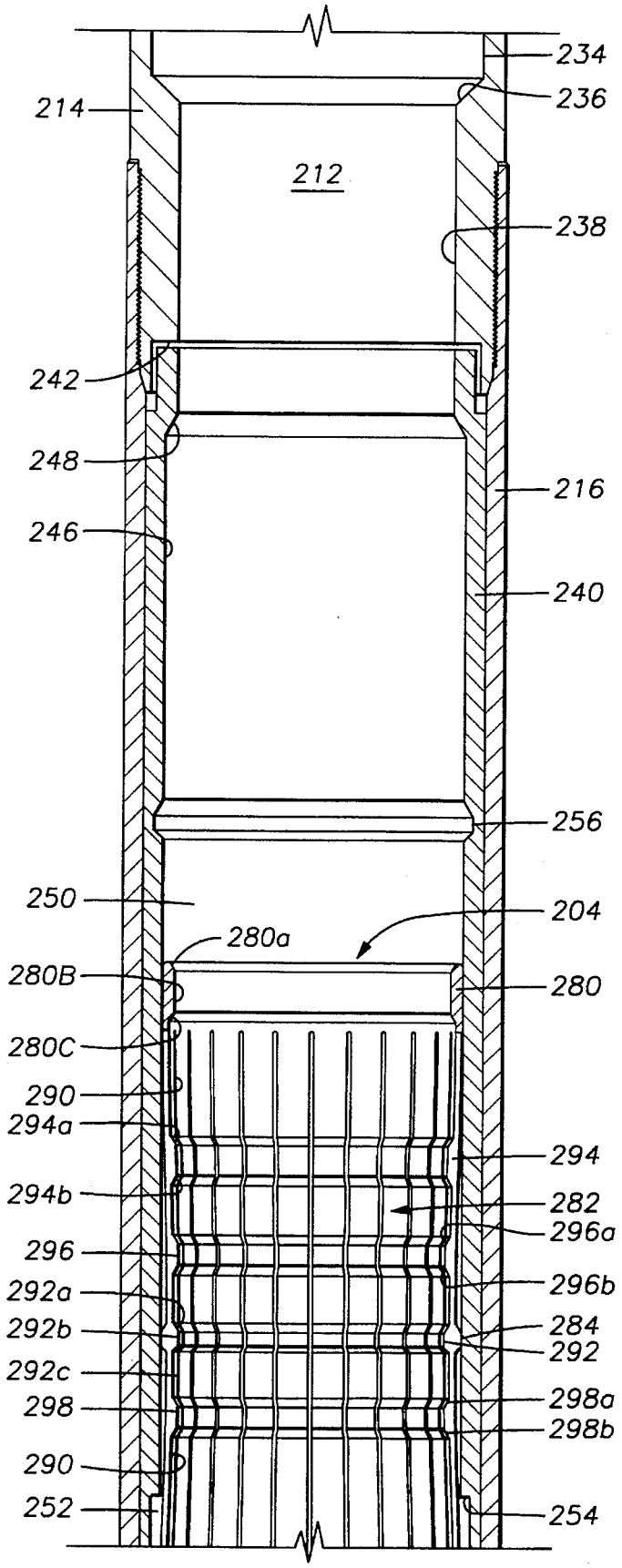
Figure 5C:
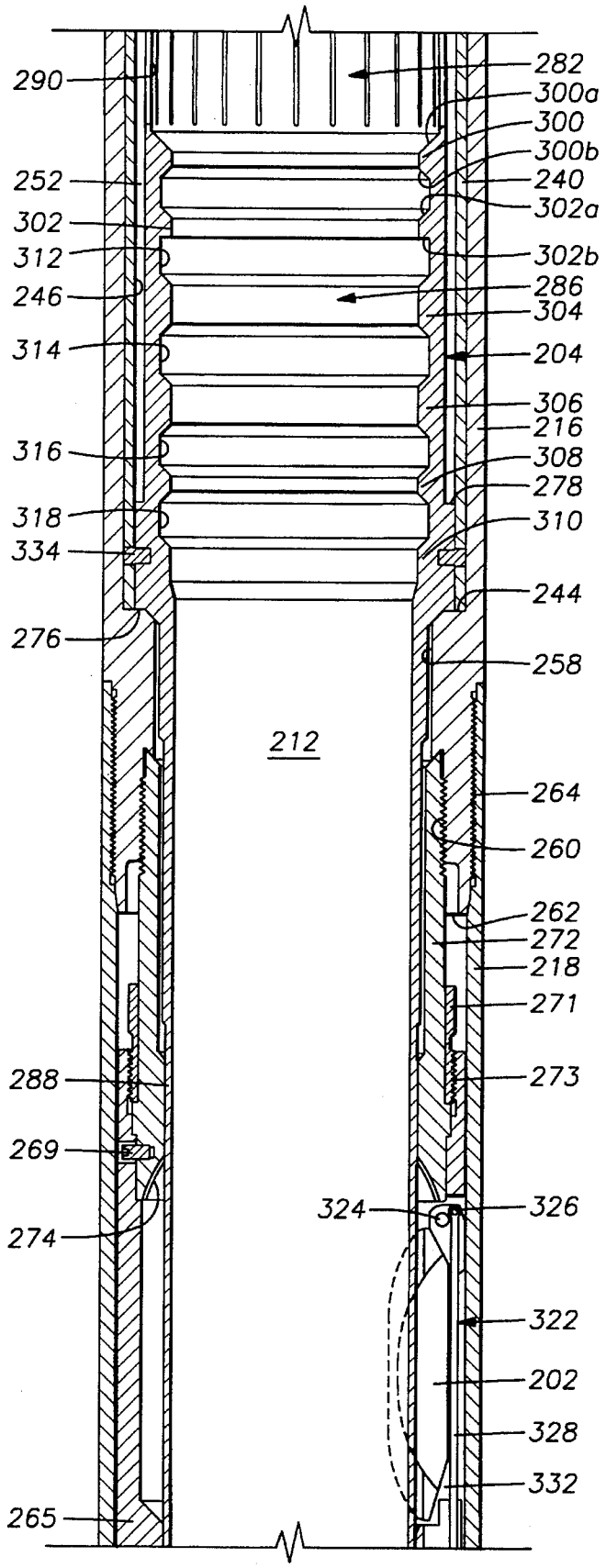

As FIG. 5C shows, the operator tube 204 is initially pinned at 334 to the tube housing 240 to retain the tube 204 in its lower position. In this position, the downward stop shoulder 276 of the operator tube 204 abuts the upward facing shoulder 244 of the intermediate sub 216. The prong portion 288 of the operator tube 204 is extended downward within the valve housing 265. The pins 334 can be varied in number to provide shear resistance in increments of 2,000 lbf up to a maximum of 24,000 lbf.

Figure 5D:
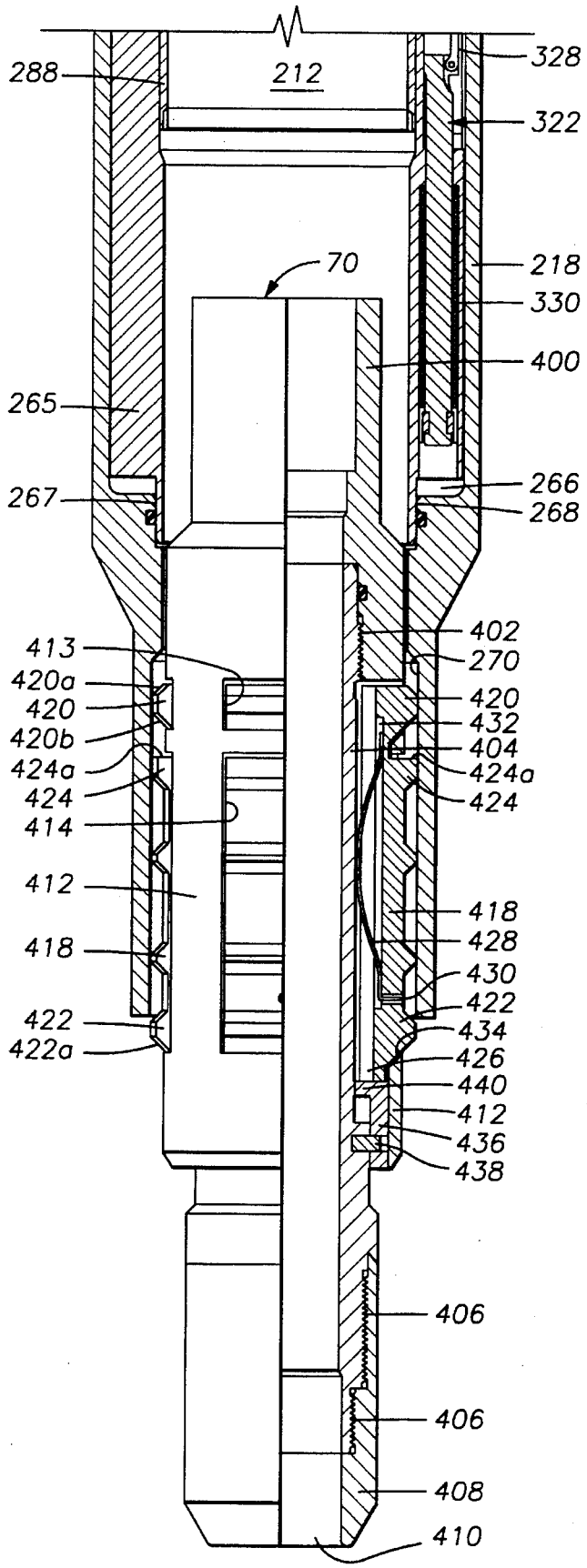

The well control valve shifter indicated schematically as 70 in FIG. 1B is also shown in greater structural detail in FIG. 5D. The shifter 70 includes an upper tubular member 400 which is affixed to or incorporated into the stimulation/shifter string 54. For clarity of the drawings, only the lower portion of the upper tubular member 400 is shown with the upper portions cut away. In fact, the upper tubular member 400 is incorporated into the shifter string 54. The upper tubular member 400 is threaded at 402 to key mandrel 404. The key mandrel 404 is threaded proximate its lower end at 406 to an end piece 408 presenting a chamfered downwardly-facing flowbore opening 410. The upper tubular member 400 includes a downwardly extending skirt 412 perforated by one or more radially spaced keyslots 413 and one or more radially spaced key windows 4 14. A set of radially moveable keys 418 include an outwardly projecting nose or upper cam head 420, a lower cam head 422 and an outwardly projecting square abutment shoulder 424. A key recess 426 is formed between the skirt 4 12 and the key mandrel 404 beneath. The keys 418 reside within the key recess 426 for radial movement through the key slots 4 13 and key windows 414 so that each key's upper cam head 420 projects through the key slot 4 13 and the abutment shoulder 424 projects through the key window 414. There are preferably four such keys 418 disposed at 90 degree angles from each other about the circumference of the key mandrel 404. The keys 418 are outwardly biased by and resiliently held away from the key mandrel 404 by means of one or more bow springs 428. Each bow spring 428 includes a lower radially outwardly projecting lower end which is received within a slot 430 in each key 418. The key recess 426 has a length that will allow the bow spring 428 to contract into a flattened position so as to be totally received within the key recess 426. An upper spring retaining slot 432 within key 418 is provided to receive a portion of bow spring 428. The upper cam head 420 presents an upwardly facing frustoconical camming surface **420*a* and a downwardly facing frustoconical camming surface 420*b*. The upper camming surface 420*a* is shaped to be complimentary to profile 300*b*. The abutment shoulder 424 presents an upper force bearing shoulder 424*a*. The lower cam head 422 presents a lower outwardly projecting camming surface 422*a*. The lower surface 434 of each key window 414 is radially inwardly sloped to form an inward camming surface which is complimentary to that of 422*a***.

The keys 418 are also maintained in key recess 426 by an annular sleeve 436 connected to the key mandrel 404 by a frangible shear pin 438. Multiple shear pins 438 are included. Annular sleeve 436 includes an inwardly projecting annular radial flange 440 bearing against the lower terminal end of keys 418 which projects within key recess 426. The outer circumferential surface of the sleeve 436 provides an annular bearing surface for the lower end of the skirt 412 of the upper tubular member 400.

In operation, the well control valve shifter 70 will automatically close the well control valve 200 as the shifter string 54 is removed from the production string 80. No independent surface control of the well control valve 200 is needed. This closing sequence is illustrated in FIGS. 6A–6B and 7A–7B. FIGS. 6A–6B show the shifter 70 moved upward within the production string 80 such that the shifter 70 has become engaged with the valve assembly 200. FIGS. 7A–7B show the valve assembly 200 having been closed by the shifter 70.

In the preengaged position of FIGS. 6A–6B, the shifter 70 is positioned such that the keys 418 are disposed within the lower bore 270 of the well control valve assembly 200. As the shifter string 54 is drawn further upward, the shifter 70 is drawn within the operator tube 204 until the keys 418 become engaged with the uncollected profiled section 286 of the operator tube 204. The upper force bearing shoulder **424*a* of the abutment shoulder 424 engages the engagement shoulder 302*b* of the uncollected profiled section 286. With this engagement, the operator tube 204 may be drawn upwardly with the shifter 70. The shifter string 54 and shifter 70 are drawn upwardly, shearing pins 334, until the position portrayed in FIGS. 7A–7B is reached. The operator tube 204 moves upwardly within the tube housing 240 until the upwardly facing shoulder 278 of the operator tube 204 engages the downwardly facing shoulder 254 of the tube housing 240. The prong section 288 of the operator tube 204 is moved above the flapper plate 202 and into the valve seat 272 permitting the flapper plate 202** to close.

When the operator tube 204 is in its upper position (as in FIGS. 7A–7B), so that the well control valve assembly 200 is closed, the relief engaging bump 284 is engaged within the notch 256 of the tube housing 240, thereby securing the operator tube 204 in its upper position. Engagement of the operator tube's upward facing stop face 278 with the stop face 254 of the tube housing 240 prevents the operator tube 204 from being moved upward excessively.

The shifter 70 may then be removed from engagement with the operator tube 204 in the following manner. Additional upward force is applied through the shifter string 54 to the upper tubular member 400 and the fixedly attached key mandrel 404 which will be sufficient to shear the pins 438 which maintain the annular sleeve 436 in position. Annular sleeve 436 will slide axially downward with respect to the key mandrel 404 to permit the keys 418 to fall radially inwardly into the key recess 426. The abutment shoulder 424 and the engagement shoulder 302 will be disengaged as the lower camming surface **422*a* of the lower cam head 422 on each key 418 is cammed inward by the lower surface 434 of the key windows 414. Inward camming of the upper cam head 420 will also assist in causing the keys 418 to fall radially inward. With the keys 418 so retracted, the shifter 70 may be removed from the well control valve assembly 200**.

It is noted that the keys 418 of the well control valve shifter 70 are profiled so that they will not stoppingly engage the internal profile of the operator tube 204 when passed downward into the well through the tube 204. Engagement will only occur in the manner described when the shifter 70 is removed from the well.

In another embodiment of the invention, a well control valve assembly 200 having a flapper plate biased in the closed position is opened by insertion of a tubular member, such as standard tubing or a work string, which forces the flapper plate to the open position. In this embodiment, which is not shown, an operator tube is not incorporated into the well control valve; the tubular member is introduced into the well control valve assembly and forcibly opens the flapper plate.

Referring now to FIGS. 8A–8D and 9A–9D, a preferred embodiment of a seal assembly 500 is shown in use with the well control valve assembly 200. The seal assembly 500 is used to reopen the well control valve assembly and to maintain it in an open position. At its upper end 502, the seal assembly 500 comprises a tubular member 504 which may be the lower portion of a completion segment or the end of another running tool. A ratch latch mechanism 506, or latching means, is disposed beneath the tubular member 504 and features a tubular seal mandrel 508 which extends downward from its attachment at 510 to the tubular member 504. The attachment 510 may be made by threads or other conventional joining techniques. A skirt collar 512 surrounds a portion of the seal mandrel 508 and includes an annular base ring 5 14 and skirt fingers 516 which extend downwardly therefrom. Each skirt finger 516 terminates at its lower end in a radially presented ridged or threaded face 518. The threads of the threaded face 518 are shaped and sized to be generally complimentary to the interior threads 84 within the upper bore 226 of the well control valve assembly 200. By virtue of the skirt fingers 516, the threaded faces 518 may be inwardly biased to a slight degree for insertion into a complimentary internally threaded member. A lock ring 520 secures the base ring 5 14 in place along the seal mandrel 508. The seal mandrel 508 also includes along its outer surface a number of raised torque transmission members 522 which are shaped and sized to fit between the skirt fingers 516 so that the seal assembly 500 can be rotationally released from well control valve assembly 200.

Below the skirt collar 512, an annular stop collar 524 is secured to the seal mandrel 508 by a number of shear screws 526 which extend through the stop collar 524 and into the mandrel 508. The stop collar 524 presents an outward and downward facing frustoconical shoulder 528.

Below the stop collar 524, a number of external bore seals, annular seal means, are positioned along the exterior of the seal mandrel 508. Seal retainer rings 530 are each maintained in position along the mandrel 508 by lock wires 532. Elastomeric seals 534 radially surround the mandrel 508 and are unitarily molded with metallic collars 536. Finally, an indicator seal assembly 538 surrounds the mandrel 508 and presents a pair of elastomeric outer seals 540.

A tubular member 542 is threaded at 544 to the seal mandrel 508. The tubular member 542 may be thought of as a "stinger" which stings into the well control valve assembly 200 to mechanically open the assembly 200 by means of tubing manipulation. The tubular member 542 has a radially enlarged upper section 546 and a reduced diameter section 548 which extends downwardly therefrom. The reduced diameter section 548 terminates in a "mule shoe" nose arrangement 550 of a type well known in the art wherein a portion of the end of the prong section 548 is cut away or chamfered at a 45 degree angle. As the enlarged upper section 546 transitions into the reduced diameter section it presents a downwardly and outwardly facing shoulder 552. The reduced diameter section 548 includes a recess 554 along its length which is defined by a downwardly and outwardly facing radially exterior shoulder 556 above and an upwardly facing shoulder 558 below. A raised annular ridge 560 is located within the recess 554 and presents an axially upper engagement face **560*a* which is shaped to be complimentary to the lower face 292*c* of engagement bump 292**.

Figure 8A:
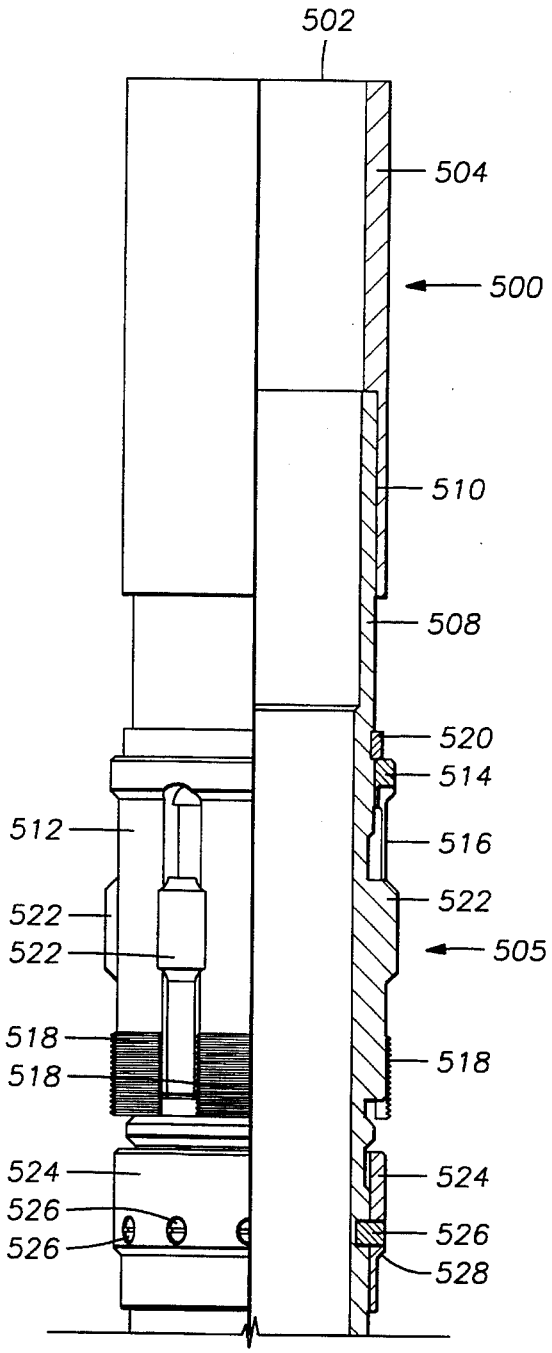
FIGS. 8A–8D present a sectional view of an exemplary well control valve constructed in accordance with the present invention prior to being returned to its open position by a seal assembly.
Figure 9A:
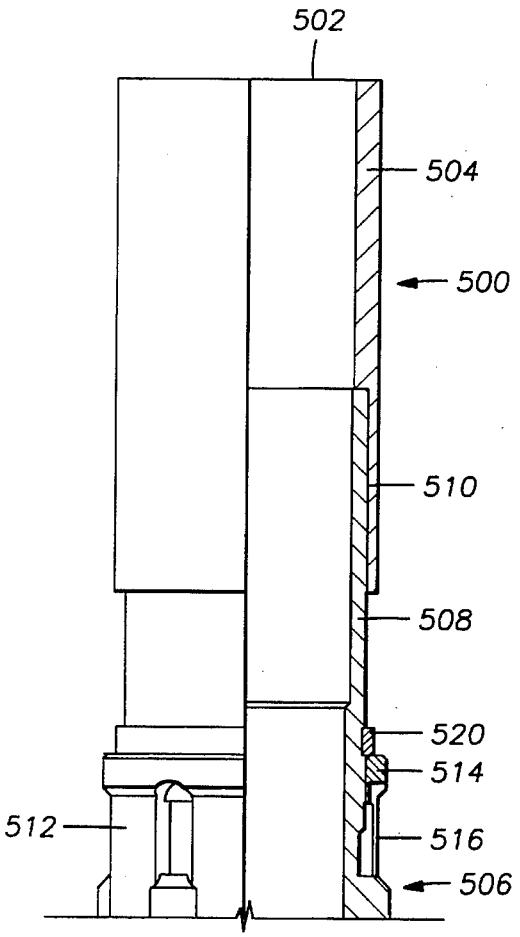
FIGS. 9A–9D present a sectional view of an exemplary well control valve constructed in accordance with the present invention after being returned to its open position by a seal assembly.
Figure 8B:
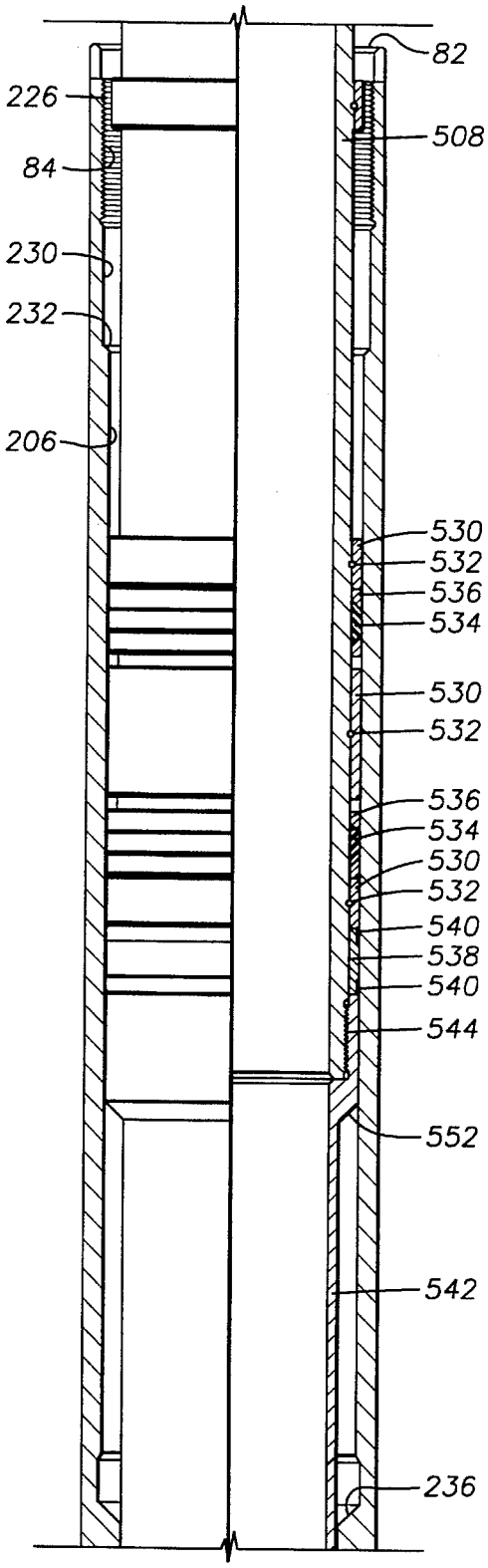
Figure 9B:
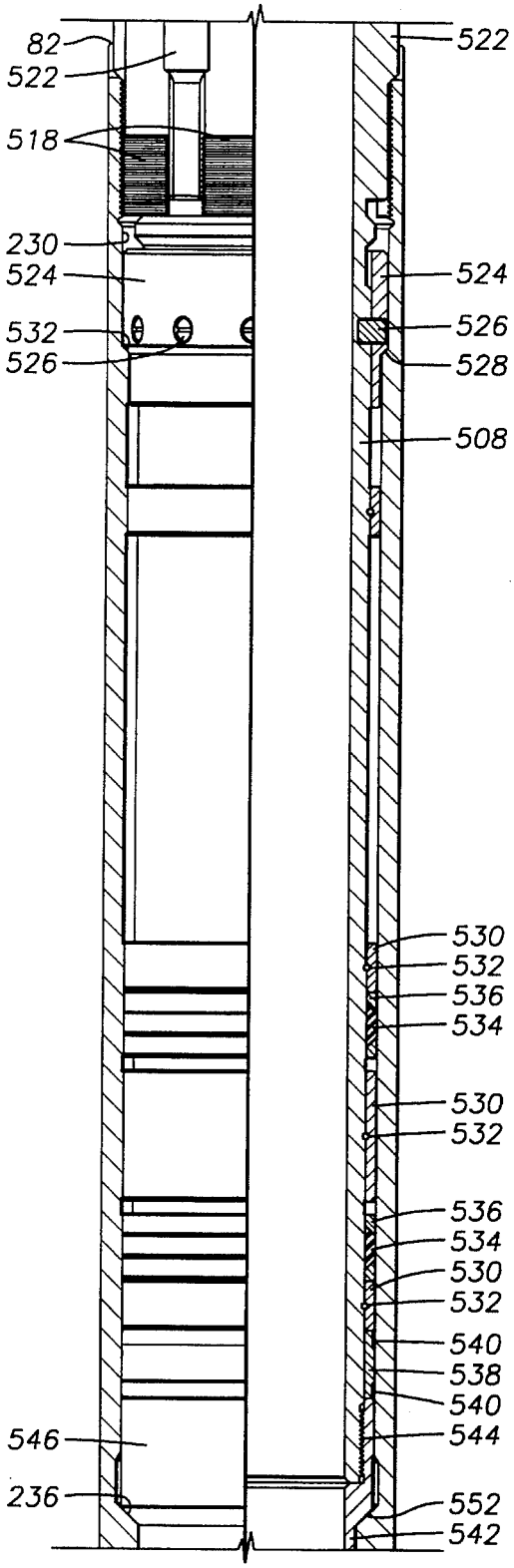

Operation of the seal assembly 500 to reopen the well control valve assembly 200 is illustrated in FIGS. 8A–8B and 9A–9B. FIGS. 8A–8B show the seal assembly being inserted into the well control valve assembly 200 just prior to opening of the flapper plate 202. FIGS. 9A–9B shown this arrangement with the valve assembly 200 having been reopened.

During insertion, the indicator seal assembly 538 will provide a positive seal with the seal bore 206 of the well control valve assembly 200. Fluid returns in the annulus 43 from fluid pumped down the flowbore 212 will essentially stop once the seal assembly 500 is inserted due to this positive seal. The absence of fluid returns indicates to the well operators that the seal assembly has entered the well control valve assembly 200 and that weight may be set down upon the seal assembly 500. The seals 534 along the prong section 548 will form a substantially fluid tight seal with the seal bore 206 of the well control valve assembly 200.

Besides the well control valve having sealing and latching means for providing a secure and substantially fluid tight connection with a complimentary seal assembly as described above, it is contemplated that the sealing and latching means could include threaded members, keyed members, slips, pins, a c-ring, or other device commonly used for attachment of tools.

Figure 8C:
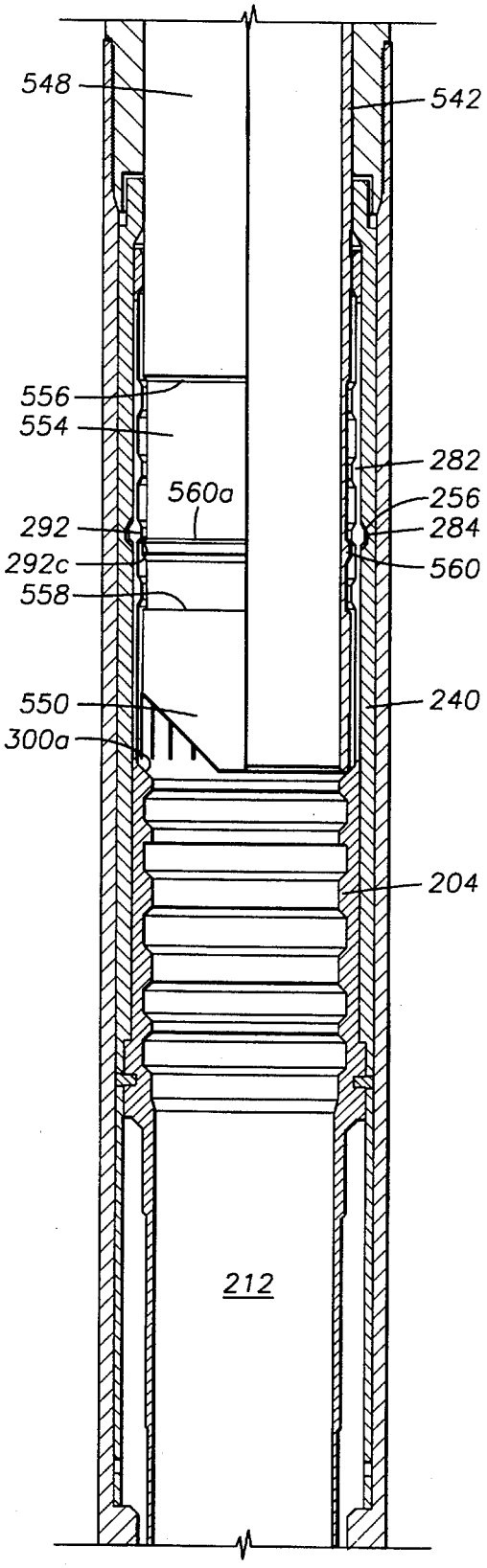
Figure 9C:
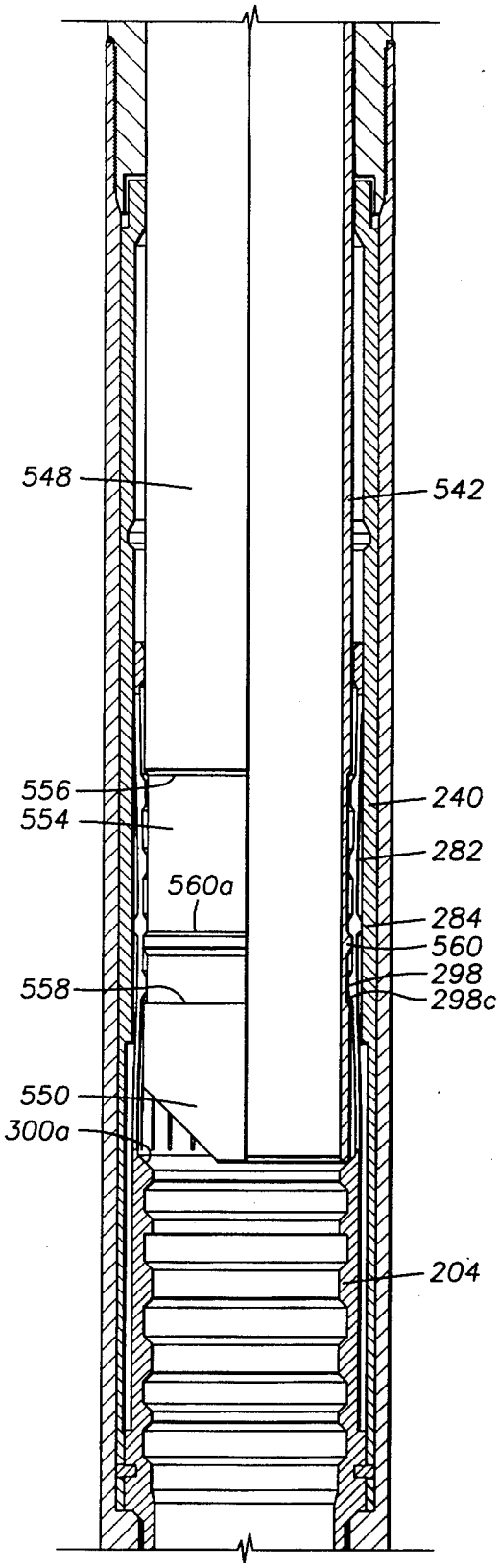
Figure 8D:
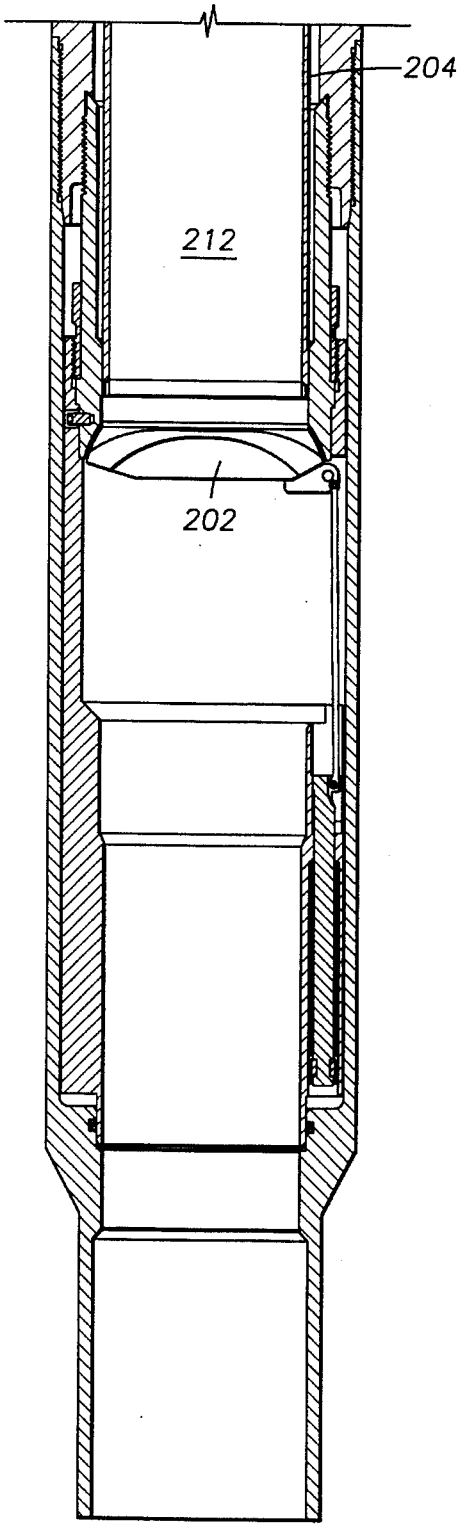
Figure 9D:
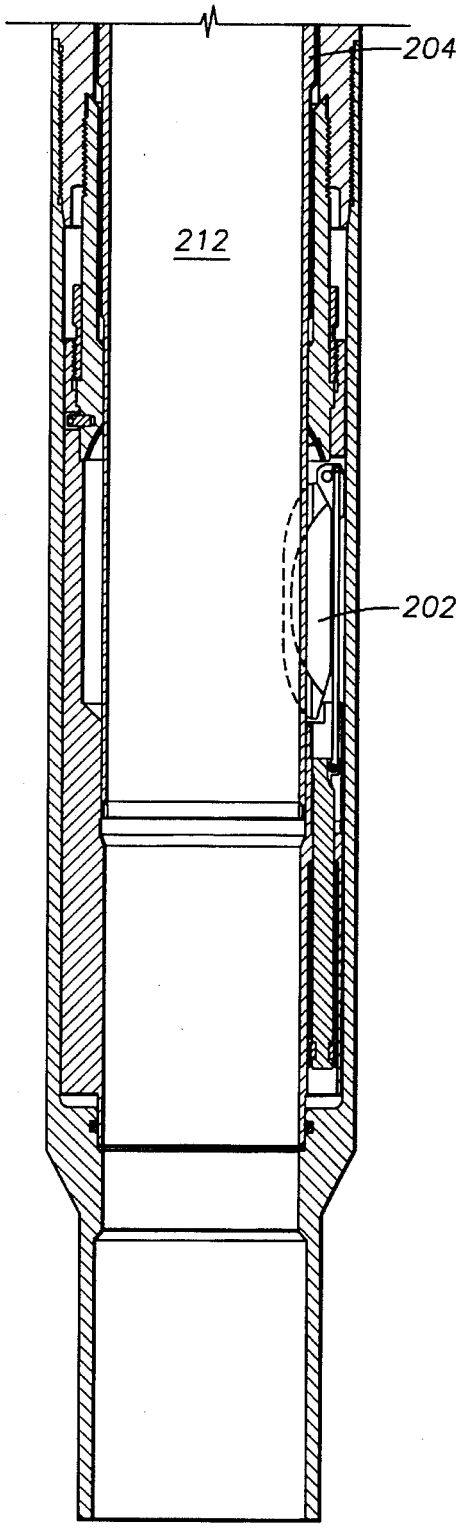

As the prong section 548 is moved downward a point is reached where the recess 554 spans the engagement bump 292 and guard bumps 294,296 and 298 of the colleted section 282 of the operator tube 204 to permit the collets of the colleted section 282 to be deflected inward. This arrangement is shown in FIG. 8C. Upwardly facing shoulder 558 will be positioned below the lowest guard bump 298. Downwardly facing engagement shoulder 556 is positioned above the upper guard bump 294. The ridge 560 will be located below engagement bump 292.

The mule shoe nose 550 at the lower end of the seal assembly 500 engages the upper abutment face **300*a* of the abutment shoulder 300. When so engaged, further downward movement of the seal assembly will force the collets of the colleted section 282 to deflect inwardly into the recess 554 and cause the recess engagement bump 284 on the radial outside of the operator tube 204 to be removed from engagement with the notch 256 in the tube housing 240. The operator tube 204 may then be moved downwardly to the position shown by FIGS. 9A–9D to mechanically open the flapper plate 202. Prior to opening the plate 202 in this manner, however, the well operator should increase pressure within the flowbore 212 in order to equalize pressure which may be trapped below the plate 202**.

The seal assembly 500 will fully open the well control valve assembly 200 when it is inserted to its fullest extent into the well control valve assembly 200. Insertion of the seal assembly 500 will ultimately be limited by the engagement of downwardly presented shoulder 552 with upwardly facing shoulder 236.

If it is desired to remove the seal assembly 500, the flapper plate 202 will be reclosed. Engagement of the upper ridge face **560*a* with the lower engagement bump face 292*c* will cause the operator tube 204 to be drawn upwardly in the tube housing 240 thereby permitting the plate 202** to reclose.

It is noted that the seal assembly 500 may be used in a number of applications which require the well control valve assembly 200 to be maintained in an open position. The seal assembly 500 might be incorporated onto the end of a tool string which is disposed within the emplaced production string 80 to reopen the well control valve assembly 200. An internal tool string would then be introduced into the production string 80 to perform additional production-related work such as additional stimulation of one or more subterranean production zones 122.

In one application, the seal assembly 500 is further incorporated into the downhole end of a subsequent completion segment to be run down the wellbore 42 and connected with the well control valve assembly of a like previously-placed completion segment. By virtue of this arrangement, a system of stacked completion segments may be constructed within the wellbore 42 with stimulation of selected production zones 122 occurring following running of a segment proximate those zones. When connection is made between adjoining completion segments, the well control valve assembly of the previously-placed segment is opened and secured into its open position. In addition, the connection between the adjoined segments is substantially sealed against fluid leakage into the annulus by virtue of the interconnection of the sealing and latching means of the well control valve assembly and the complimentary annular seal means of the complimentary seal assembly. The described system affords the advantage of hydraulic control over the well fluids within the wellbore 42.

Figure 10A:
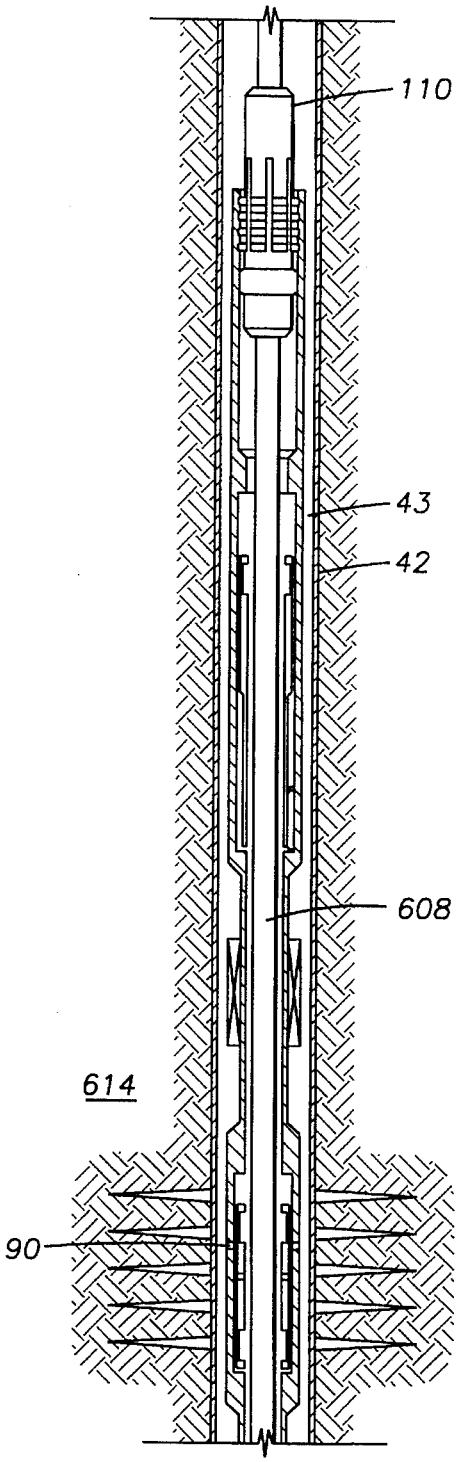
FIGS. 10A–10B present a schematic view of a production arrangement employing stacked completion segments.
Figure 10B:
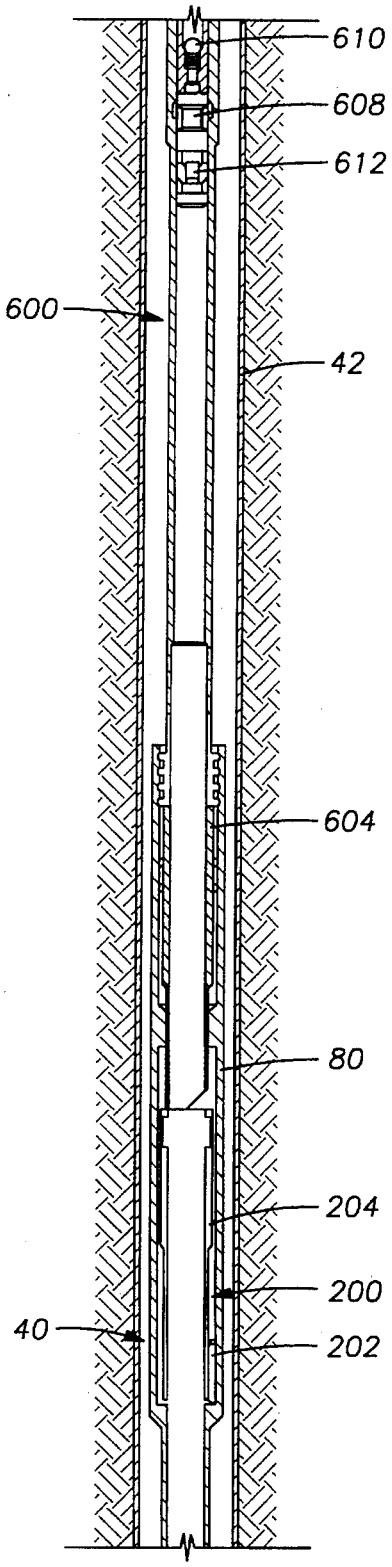

Referring now to FIGS. 10A–10B, this system is described in further detail. The discussion with respect to FIGS. 1A–1B through 4A–4B described the testing and running of an initial completion segment 40 and use of the segment to stimulate production zones 122. FIGS. 10A–10B illustrate the running of an exemplary subsequent completion segment 600 and its connection to the adjoining previously-placed segment. The subsequent completion segment 600 is affixed at its upper end to the running tool in the manner described previously so that it may be disposed into the wellbore 42. The subsequent completion segment 600 includes an outer production tubing string 602 which is similar in most respects to the production string 80 of completion segment 40. However, the lower end of the tubing string 602 includes a seal assembly 604 incorporated thereupon. The upper end of the tubing string 602 features a well control valve assembly 606 which is constructed and operates the same as valve assembly 200 previously described.

Contained radially within the production tubing string 602 is a stimulation/shifter string 608 which is affixed at its upper end to the running tool 110 and axially moveable within the tubing string 602. The stimulation/shifter string 608 is similar in most respects to the stimulation/shifter string 54 described previously. String 608 features an opening shifter, closing shifter and a locating shifter (not shown) along its length. The string 608 also includes a velocity check valve 610 and a well control valve shifter 612, which is placed to be the lowest component on the string 608.

The subsequent completion segment 600 might be run and attached to the initial completion segment 40, for instance, in order to accomplish stimulation of production zones such as 614 which lie above the initial completion segment 40. As FIG. 10B illustrates, the seal assembly 604 of the subsequent production segment 600 is insertable within the well control valve assembly 200 of the initial segment 40 to reopen the valve assembly 200 and effect a fluid seal between the two segments. Once stimulation of desired areas has been accomplished, the running tool 110 and stimulation/shifter string 608 may be removed from the wellbore 42. During removal, the well control valve shifter 612 will close the well control valve assembly 606 of the subsequent completion segment 600.

One advantage of the invention as described thus far is the ability of the well operator to run a tool and stimulate subterranean zones during removal of the running tool as opposed to making two or more trips into the well. Further, the production tubing string remains set and packed off in a hydraulically stable condition due to the closed well control valve assembly. This is a great advantage in horizontal or deviated wellbores where hydraulic control has been a problem.

Figure 11:
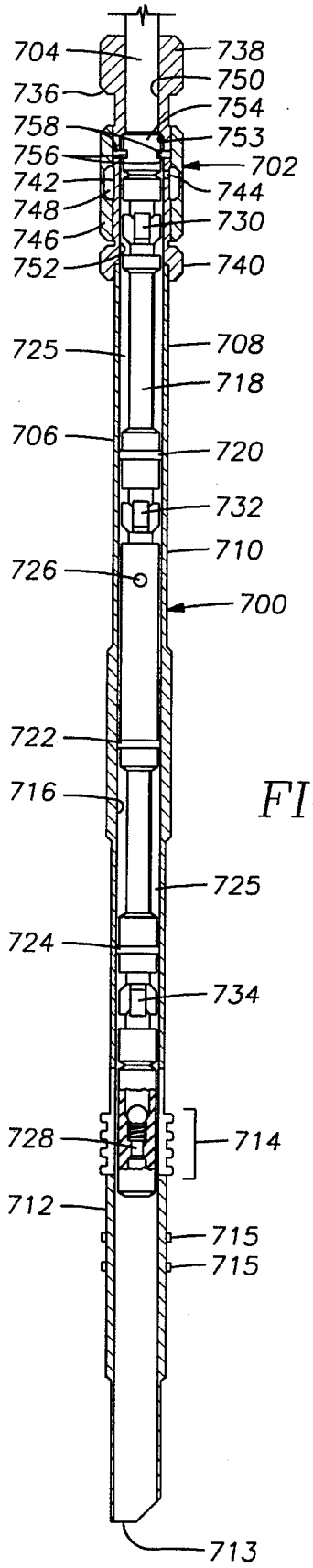
FIG. 11 shows an exemplary contingency reentry tool constructed in accordance with the present invention.

In another application, the seal assembly 500 is incorporated into a contingency reentry tool 700 which is used to reopen the well control valve 200 so that additional tools may be inserted within the production string 80 to perform stimulation or other functions. Referring now to FIG. 11, an exemplary contingency reentry tool 700 is shown which is attached by means of a hydraulic release tool 702 to a running string 704 upon which the tool is lowered into a borehole. The contingency reentry tool 700 includes an outer tubular housing 706 which may be thought of as being divided into an upper section 708, central section 710 and lower prong section 712. The prong section 712 has a ratch latch 714 and annular seals 715 and terminates in a mule shoe nose 713 of the type described earlier with respect to construction of the seal assembly 500. The annular seals 715 are preferably elastomeric seals, but may be either elastomeric seals, polymeric seals, metallic seals, or any combination of these seals. The central section 710 of the housing 706 includes a reduced diameter polished bore, indicated by the bulged portion of the tubing string at 716.

It is noted that the prong section 712 corresponds to that of the prong section 548 of the seal assembly 500 previously described in detail. The ratch latch 714 corresponds to the ratch latch mechanism 506 of the seal assembly 500. The mule shoe nose 713 corresponds to the mule shoe nose 550 of the seal assembly 500, and so forth. The contingency reentry tool 700 is constructed in other details the same as or similar to that of seal assembly 500. For brevity of discussion and clarity of the drawings, these details are, therefore, not shown on the drawings or described herein. For example, the annular seal retainer rings 530 of the seal assembly 500 are not shown in connection with the contingency reentry tool 700.

The contingency reentry tool 700 also includes an inner shifter string 718 carrying an upper annular seal 720, central annular seal 722 and lower annular seal 724. The seals are shaped and sized such that they will form a substantially fluid tight seal when located within the polished bore 716 and will not form a fluid tight seal when located outside of the polished bore 716 within the housing 706. A radial fluid passage 725 is defined between the inner shifter string 718 and the outer tubular housing 706. It is to be understood that fluid may be transmitted through the passage 725 along virtually the entire length of the contingency reentry tool 700 except across an annular seal 720, 722 or 724 while one of those seals is located within the reduced diameter polished bore 716. An acid flow port 726 is located between the upper and central seals 720 and 722. A velocity check valve 728 is located in the lower portion of the shifter string 718. The string 718 also carries an opening shifter 730, locating shifter 732 and closing shifter 734 along its length for operation of subterranean sleeve valves used for selective stimulation of subterranean production zones.

Figure 12A:
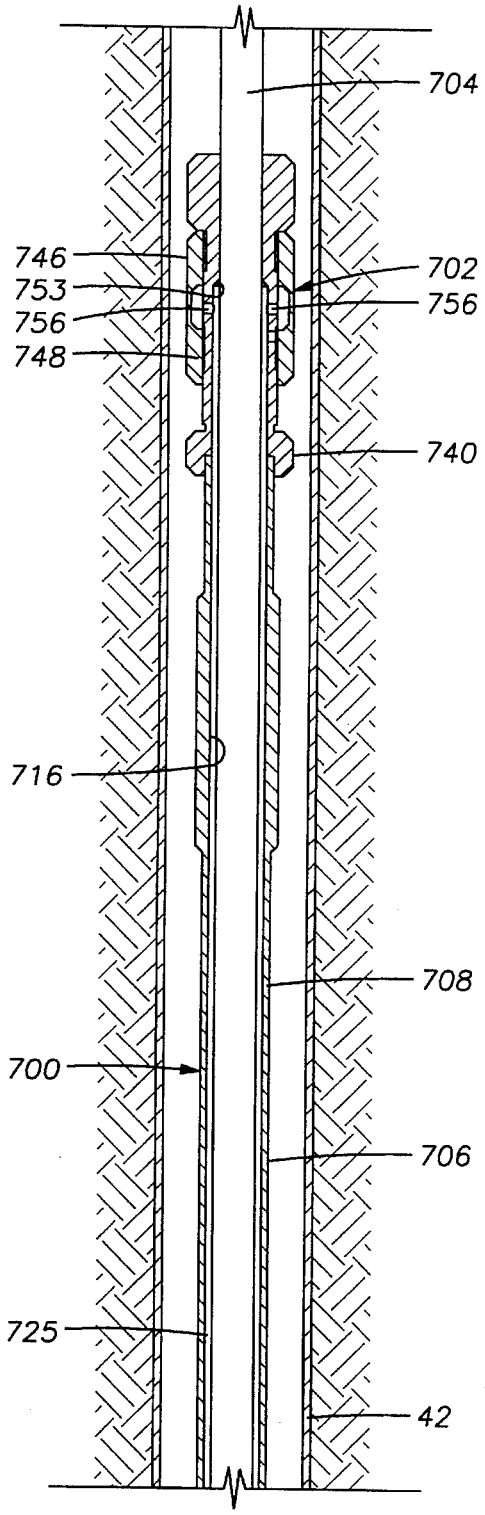
FIGS. 12A–12B illustrate use of a contingency reentry tool to reopen a closed well control valve and having the tool string released from its locked relation with the housing 506 for further disposition within wellbore.
Figure 12B:
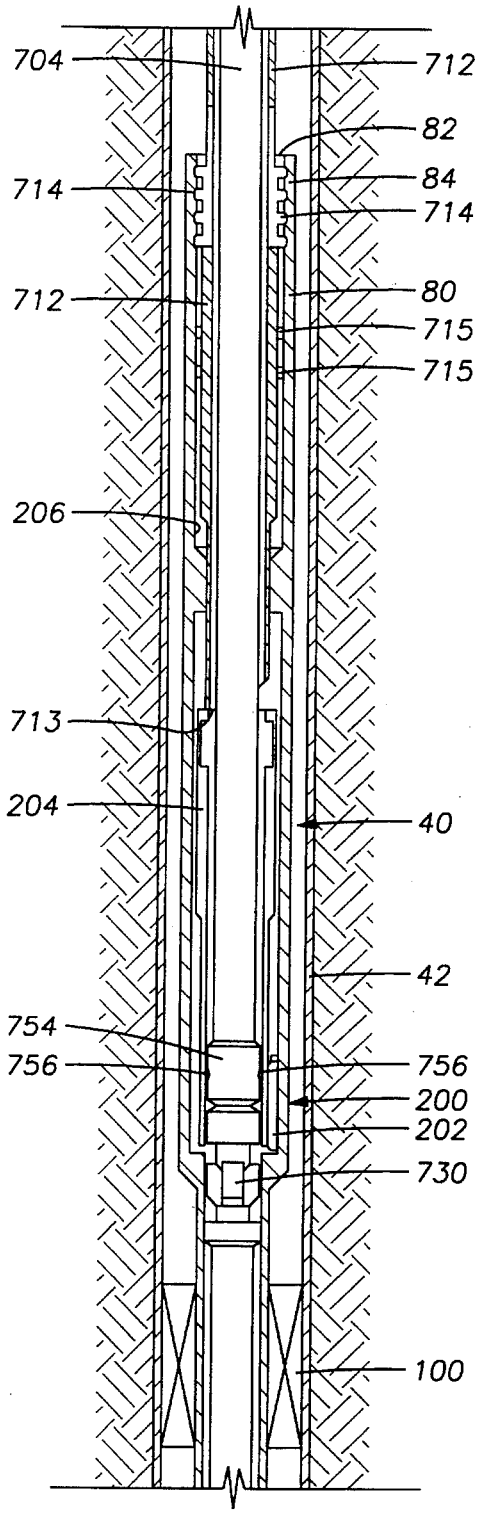

The construction and operation of the hydraulic release tool 702 is understood by reference to FIGS. 11 and 12A–12B. The release tool 702 features a tubular housing 736 presenting an enlarged upper end 738 and lower end 740. Between the enlarged ends extends a central section 742 of reduced outer diameter which is ported at 744 to permit fluid flow therethrough. An outer sleeve 746 surrounds the central section 742 and is slidably moveable thereupon between a lower position (FIG. 11) and an upper position (FIG. 12A). The outer sleeve 746 presents an internal annular recess 748 and, when the sleeve 746 is in its lower position, fluid may be transmitted into the annular recess 748 through the port 744. Movement of the outer sleeve into an upper position (as shown in FIG. 12A) will occur when sufficient differential pressure is applied.

The tubular housing 736 encloses a cylindrical bore 750 with an enlarged lower portion 752 defined at its top by a downwardly facing "no go" shoulder 753. An enlarged collar 754 located between and connecting the shifter string 718 and running string 704 is disposed within the enlarged lower portion 752. The enlarged collar 754 must be of a radial diameter such that the collar will fit within the enlarged lower portion 752 but can not enter the upper section of the cylindrical bore 750 due to engagement with the no go shoulder 753. A pair of notches or recesses 756 are cut or milled into the exterior radial surface of the collar 754. A complimentary set of pins 758 are disposed through the central section 742 and within the notches 756 in a cantilever fashion. The pins 758 are mechanically-biased to move radially outward unless restrained from this movement. As shown in FIG. 11, the pins 758 are maintained in place by the sleeve 746 which, in its lower position, maintains the pins within the notches 756. As a result of this pin arrangement, the shifter string 718 is maintained in a locked relation, longitudinally and against rotation, to the outer housing 706. The configuration illustrated in FIG. 11 portrays the contingency reentry tool 700 as it is disposed into a wellbore with the shifter string 718 initially in this locked relation.

Turning now to FIGS. **12A–12*b*, the tool contingency reentry 700 is shown being disposed within the representative wellbore 42 and reentering the well control valve assembly 200 of completion segment 40. The contingency reentry tool 700 has reopened the well control valve assembly 200 and the shifter string 718 has been unlocked for further disposal within the wellbore 42. To reopen the valve, the contingency reentry tool 700 has been disposed via the running string 704 within the wellbore 42 until the prong section 708 of the housing 706 enters the upper end 82 of the production string 80 and engages the upper end of the operator tube 204 with the mule shoe nose 713. The elastomeric seals 715 should engage and create a seal with the seal bore 206. At this point, the well operator should pressure down through the running string 704 until fluid pressure above the flapper plate 202 is equalized against the fluid pressure trapped below the flapper plate 202. As the downward fluid pressure equalizes, downward movement of the running string 704 will cause the flapper plate 202 to be opened. As the plate 202 is opened, the operator tube 204 is moved downward to maintain it in its open position. As the contingency reentry tool 700 is moved further downward within the well control valve assembly 200, the ratch latch 714 engages the threads 84 of the upper portion 82**.

Once the well control valve assembly 200 has been reopened, the operator unlocks the shifter string 718 from the outer tubular housing 706 for further disposal within the completion segment 40. With the string 718 and housing 706 locked (as in FIG. 11) fluid is directed down within the string 718 under pressure until the velocity check valve 728 closes. With the valve 728 closed, fluid will then flow through port 726 and into the flow passage 725. The fluid will be prevented from downward movement along the passage 725 by the seal effected by the presence of annular seal 722 in the polished bore 716. As the fluid pressure increases within the passage 725, it will pass through port 744 and enter the recess 748, thereby causing the sleeve 746 to move to its upper position. With the sleeve 746 in the upper position (FIG. 12A), the pins 758 become free to move radially outward into the recess 748, unlocking the string 718 for axial movement with respect to the surrounding housing 706.

After the stimulation/shifter string 718 has been disposed further within the completion segment 40 and additional stimulation has been performed, the contingency reentry tool 700 may be removed in the following manner. The running string 704 is drawn upward to withdraw the string 718. The enlarged collar 754 will enter the enlarged bore section 752 and engage the no go shoulder 753. Thus engaged, further withdrawal of the string 704 will result in withdrawal of the engaged housing 706 from the well control valve assembly 200. Withdrawal of the prong section 712, as detailed earlier during discussion of seal assembly operation, will result in reclosing of the well control valve assembly 200 once more.

It should be understood by those persons skilled in the art that the present invention is readily susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such embodiments, adaptations, variations, modifications and equivalent arrangements, the present invention being limited only by the claims appended hereto and the equivalents thereof.

What is claimed is:

1. A tubing-manipulated valve assembly for control of fluid flow in a flowbore, the valve assembly comprising:

a pivotable flapper plate being specially-shaped to include a semicylindrical channel which substantially aligns with a flowbore when the plate is in an open position to cause the plate to conform closely to the interior profile of a wellbore;

the plate being operable by tubing manipulation between an open position wherein the plate is generally aligned with the flowbore and a closed position wherein the plate substantially seals the flowbore.

2. The valve assembly of claim 1 wherein the plate is moved to its closed position by movement of a first tubular member relative to the flapper plate.

3. The valve assembly of claim 2 wherein said first tubular member is incorporated into said valve assembly.

4. The valve assembly of claim 2 wherein the plate is moved to its open position by insertion of a second tubular member into the valve assembly.

5. The valve assembly of claim 4 wherein said second tubular member is incorporated in a seal assembly.

6. The valve assembly of claim 4 wherein the second tubular member comprises a stinger.

7. The valve assembly of claim 1 further including an operator tube which is moveable between a first position wherein the shaped plate is maintained in an open position by said operator tube and a second position wherein the shaped plate is not maintained in an open position.

8. The valve assembly of claim 7 wherein the operator tube presents a profiled interior cylindrical surface by which the operator tube may be engaged by a complimentarily profiled member for movement of the operator tube between the first and the second positions.

9. A tubing-manipulated valve assembly for control of fluid flow with a well bore, the valve assembly comprising:

a. a generally cylindrical housing assembly enclosing a flow bore for fluid flow therethrough;

b. a flapper plate within the housing assembly and being pivotable by tubing manipulation between an open position, wherein fluid may be flowed through the flow bore, and a closed position wherein the flow bore is closed to fluid flow, the plate being specially-shaped to conform closely to the interior profile of a well bore; and c. a biasing means whereby said flapper plate is biased toward the closed position.

10. The valve assembly of claim 9 wherein said basing means comprising a compression spring-biased tension member affixed to the flapper plate a proximate distance from the plate's pivot point such that a moment arm is established between the pivot point and the point of affixation of the tension member, the flapper plate being biased toward the closed position by moment imparted to the moment arm by maintenance of the tension member in tension.

11. The valve assembly of claim 9 wherein the housing assembly further comprises a sealing means and latching means for providing a secure and substantially fluid tight connection with a complimentary seal assembly.

12. The valve assembly of claim 11 comprising:

a reduced diameter seal bore for engagement with complimentary annular seal means of the seal assembly; and a notched upper end, the notches being shaped and sized to receive complimentarily shaped and sized members within.

* * * * *